US006473922B1

(12) United States Patent
Sommerfeld et al.

(10) Patent No.: US 6,473,922 B1
(45) Date of Patent: Nov. 5, 2002

(54) KINEMATIC MOTION OF ARTICULATED BED

(75) Inventors: Dean R. Sommerfeld, Jola, WI (US); Todd C. Kramer, Plover, WI (US)

(73) Assignee: Sunrise Medical HHG Inc., Longmont, CO (US)

( * ) Notice: Subject to any disclaimer, the term of this patent is extended or adjusted under 35 U.S.C. 154(b) by 87 days.

(21) Appl. No.: 09/661,829

(22) Filed: Sep. 14, 2000

Related U.S. Application Data

(60) Provisional application No. 60/154,154, filed on Sep. 15, 1999.

(51) Int. Cl.[7] ..... A47B 9/00
(52) U.S. Cl. ..... 5/610; 5/627; 5/611
(58) Field of Search ..... 5/610, 613, 617, 5/618, 620, 627, 625, 611

(56) References Cited

U.S. PATENT DOCUMENTS 3,743,344 A * 7/1973 Jameson ..... 296/20
4,921,295 A * 5/1990 Stollenwerk ..... 296/20
5,572,756 A * 11/1996 Muuranen et al. ..... 296/20

* cited by examiner

*Primary Examiner*—Heather Shackelford
*Assistant Examiner*—Fredrick Conley
(74) *Attorney, Agent, or Firm*—MacMillan, Sobanski & Todd, LLC

(57) ABSTRACT

An articulated bed comprises a main frame supported by a leg tube. An upper portion of the leg tube is longitudinally and pivotally displaceable relative to the main frame at an upper movable pivot point. A lower portion of a stabilizer is connected to a lower intermediate portion of the leg tube at a lower orbital pivot point. An upper portion of the stabilizer is pivotally connected relative to said main frame at an upper fixed pivot point. A wheel is pivotally attached to a lower portion of the leg tube at a pivot axis. The upper movable pivot point, the lower orbital pivot point, and the pivot axis do not coalign and the distance between the upper fixed pivot point and the upper movable pivot point are maximized when the main frame is in a raised position.

20 Claims, 15 Drawing Sheets

| | | |
|---|---|---|
| a | 14.5 | 0 |
| b | 17 | 0 |
| d | 16.75 | 0 |
| be | 0.261799 | 15 Degrees |
| | | |
| av | 0.875 | 0 |
| | | |
| m | 4.338219 | |
| n | 16.17928 | |
| x | 30.98404 | |
| t | 0.140378 | Radians |
| | | |
| Force | [redacted] | |
| | | |
| Cable Diameter | 0.25 | |
| Cable Length | 70.7 | |
| | | |
| Tube Size | | |
| 1x2.5x.065 S | 0.427564 | |
| | | |
| Slider Tube (AT-AZ) | | |
| ID | 1.12 | [redacted] |
| OD | 1.25 | 0.066164 |
| E | 30000000 | |
| length | 25.5 | [redacted] |
| | | 0.042902 |
| | | |
| Leg @ Caster | 1.97 | |
| Leg @ Pivot | 1 | |
| Angle to 2-3 | 45 | |
| Lock length | 15.8 | |

| | Gamma | X (s-z) | Y | Gam. Rad | z | R | R + dr | Alpha Rad | g | c | s | w | R hor | Difference | Angle between d and s |
|---|---|---|---|---|---|---|---|---|---|---|---|---|---|---|---|
| | | | 0.009814279 | | | | | | | -0.009192665 | | | | | |
| | 14.9939 | 0.328554 | 3.249102721 | 0.261694 | 19.4212 | 3.523169 | 4.388169 | 0.245435 | 14.06546 | 30.46665287 | 16.74776 | 1.085908 | 30.81322 | -0.32995 | 0.016364 |
| | 15.9939 | 0.407521 | 3.876395419 | 0.279147 | 16.34194 | 3.809109 | 4.684109 | 0.262616 | 13.99074 | 30.33287646 | 16.74986 | 1.180304 | 30.7406 | -0.40792 | 0.004017 |
| | 16.9939 | 0.487304 | 4.502420415 | 0.2965 | 18.25771 | 4.093602 | 4.968602 | 0.280209 | 13.94016 | 30.16788114 | 16.74601 | 1.275806 | 30.68517 | -0.4873 | 0.02441 |
| | 17.9939 | 0.568667 | 5.126990438 | 0.314054 | 16.16832 | 4.376581 | 5.251581 | 0.306615 | 13.82573 | 29.99224647 | 16.73318 | 1.372527 | 30.55821 | -0.56467 | 0.044816 |
| | 18.9939 | 0.639909 | 5.749931938 | 0.331507 | 15.0744 | 4.657981 | 5.532981 | 0.322037 | 13.73147 | 29.80587866 | 16.71437 | 1.470584 | 30.44584 | -0.63997 | 0.065238 |
| | 19.9939 | 0.713169 | 6.371022386 | 0.34899 | 13.97539 | 4.937655 | 5.812655 | 0.347478 | 13.0334 | 29.60679133 | 16.68856 | 1.570101 | 30.32196 | -0.71317 | 0.085879 |
| | 20.9939 | 0.784225 | 6.990115992 | 0.366415 | 15.87151 | 5.215579 | 6.093579 | 0.367941 | 13.52951 | 29.4010242 | 16.65574 | 1.671211 | 30.18525 | -0.78422 | 0.106142 |
| | 21.9939 | 0.853089 | 7.607018136 | 0.383867 | 15.7828 | 5.491847 | 6.369847 | 0.388428 | 13.41983 | 29.18262708 | 16.61589 | 1.774053 | 30.03572 | -0.85309 | 0.126629 |
| | 22.9939 | 0.919714 | 8.221548364 | 0.40132 | 15.64928 | 5.765776 | 6.640776 | 0.408943 | 13.30435 | 28.93383754 | 16.588 | 1.878776 | 29.87335 | -0.91971 | 0.147144 |
| | 23.9939 | 0.984047 | 8.833527889 | 0.418773 | 15.531 | 6.037863 | 6.912863 | 0.429488 | 13.18300 | 26.71409725 | 16.51535 | 1.985539 | 29.69814 | -0.98405 | 0.167689 |
| | 24.9939 | 1.046033 | 9.442779735 | 0.436227 | 15.40798 | 6.307863 | 7.182863 | 0.450068 | 13.05609 | 28.4640478 | 16.45402 | 2.094511 | 29.51008 | -1.04603 | 0.188268 |
| | 25.9939 | 1.105615 | 10.04912847 | 0.45368 | 15.28029 | 6.575886 | 7.450886 | 0.470684 | 12.92324 | 28.20952849 | 16.3838 | 2.205877 | 29.30914 | -1.10562 | 0.208885 |
| | 26.9939 | 1.162733 | 10.65240242 | 0.471133 | 15.14763 | 6.841259 | 7.716259 | 0.491342 | 12.78488 | 27.93956297 | 16.31096 | 2.319633 | 29.09531 | -1.16273 | 0.229543 |
| | 27.9939 | 1.217314 | 11.25242939 | 0.488587 | 15.01999 | 7.104431 | 7.979431 | 0.512045 | 12.6403 | 27.65124699 | 16.22827 | 2.435564 | 28.86856 | -1.21731 | 0.250245 |
| | 28.9939 | 1.269293 | 11.84904175 | 0.50604 | 14.88841 | 7.365493 | 8.240103 | 0.532797 | 12.49015 | 27.35955879 | 16.1387 | 2.553692 | 28.62865 | -1.26929 | 0.270997 |
| | 29.9939 | 1.318594 | 12.4420737 | 0.523493 | 14.72233 | 7.623445 | 8.498445 | 0.553602 | 12.33422 | 27.05755376 | 16.04102 | 2.67948 | 28.37815 | -1.31859 | 0.291803 |
| | 30.9939 | 1.366135 | 13.03136228 | 0.540946 | 14.57277 | 7.879408 | 8.754408 | 0.574460 | 12.1725 | 26.74526404 | 15.9379 | 2.806434 | 28.1104 | -1.36613 | 0.312667 |
| | 31.9939 | 1.408829 | 13.61674756 | 0.5584 | 14.41777 | 8.132105 | 9.007105 | 0.595394 | 12.00495 | 26.42272105 | 15.8286 | 2.935659 | 27.83155 | -1.40883 | 0.333594 |
| | 32.9939 | 1.446581 | 14.19907203 | 0.575853 | 14.26038 | 8.382358 | 9.257358 | 0.61639 | 11.83157 | 26.08994861 | 15.76798 | 3.071389 | 27.53953 | -1.44658 | 0.354591 |
| | 33.9939 | 1.48729 | 14.77518523 | 0.593306 | 14.09464 | 8.629791 | 9.504791 | 0.637462 | 11.65233 | 25.74696817 | 15.58193 | 3.210662 | 27.23426 | -1.48729 | 0.375663 |
| | 34.9939 | 1.521845 | 15.34793518 | 0.61076 | 13.92661 | 8.874329 | 9.749329 | 0.658616 | 11.46718 | 25.39379786 | 15.44846 | 3.354079 | 26.91564 | -1.52185 | 0.396818 |
| | 35.9939 | 1.553127 | 15.91617777 | 0.628213 | 13.75434 | 9.116867 | 9.990867 | 0.679858 | 11.2761 | 25.03044412 | 15.36747 | 3.504705 | 26.58357 | -1.55313 | 0.418059 |
| | 36.9939 | 1.581003 | 16.47977251 | 0.645665 | 13.57788 | 9.356421 | 10.22942 | 0.701197 | 11.07903 | 24.65880940 | 15.15886 | 3.660382 | 26.23791 | -1.581 | 0.439387 |
| | 37.9939 | 1.60533 | 17.03856402 | 0.663118 | 13.39729 | 9.58983 | 10.46483 | 0.722641 | 10.8759 | 24.27318873 | 15.00262 | 3.822582 | 25.87852 | -1.60533 | 0.460841 |
| | 38.9939 | 1.62595 | 17.59246258 | 0.680573 | 13.21261 | 9.822051 | 10.69705 | 0.744198 | 10.66684 | 23.879258 | 14.83856 | 3.991953 | 25.50521 | -1.62595 | 0.4824 |
| | 39.9939 | 1.642687 | 18.14134484 | 0.698026 | 13.02391 | 10.05101 | 10.92601 | 0.765883 | 10.45118 | 23.47508758 | 14.6666 | 4.169228 | 25.11777 | -1.64269 | 0.504083 |
| | 40.9939 | 1.655347 | 18.68505266 | 0.715479 | 12.83124 | 10.27665 | 11.15165 | 0.787703 | 10.22939 | 23.06063468 | 14.48659 | 4.355246 | 24.71608 | -1.65535 | 0.525903 |
| | 41.9939 | 1.663714 | 19.22350096 | 0.732933 | 12.63468 | 10.49949 | 11.37349 | 0.809672 | 10.00117 | 22.63569309 | 14.29936 | 4.550985 | 24.30005 | -1.66371 | 0.547873 |
| | 42.9939 | 1.667546 | 19.75598076 | 0.750386 | 12.43424 | 10.71766 | 11.59266 | 0.831806 | 9.76636 | 22.20059744 | 14.10175 | 4.757494 | 23.86914 | -1.66755 | 0.570009 |
| | 43.9939 | 1.666659 | 20.28422141 | 0.767839 | 12.23002 | 10.9329 | 11.8079 | 0.85412 | 9.524793 | 21.75481664 | 13.89659 | 4.976121 | 23.42339 | -1.66657 | 0.592321 |
| | 44.9939 | 1.660475 | 20.80832999 | 0.785293 | 12.02206 | 11.14455 | 12.01955 | 0.876653 | 9.276266 | 21.29835048 | 13.68256 | 5.208351 | 22.96863 | -1.66048 | 0.614834 |
| | 45.9939 | 1.648915 | 21.32283915 | 0.802746 | 11.81048 | 11.35253 | 12.22753 | 0.899397 | 9.020537 | 20.83102039 | 13.4594 | 5.456962 | 22.47994 | -1.64892 | 0.637567 |
| | 46.9939 | 1.631463 | 21.83370948 | 0.820199 | 11.59529 | 11.55679 | 12.43179 | 0.922345 | 8.757319 | 20.35260489 | 13.22677 | 5.721062 | 21.98409 | -1.63148 | 0.660545 |
| | 47.9939 | 1.607714 | 22.33093847 | 0.837652 | 11.37655 | 11.75726 | 12.63226 | 0.945595 | 8.486275 | 19.85282705 | 12.98427 | 6.006206 | 21.47694 | -1.60771 | 0.683796 |
| | 48.9939 | 1.577067 | 22.83842929 | 0.855106 | 11.15436 | 11.95388 | 12.82888 | 0.969152 | 8.208987 | 19.36134586 | 12.73145 | 6.314462 | 20.93841 | -1.57707 | 0.707352 |
| | 49.9939 | 1.538906 | 23.33229287 | 0.872559 | 10.92876 | 12.1466 | 13.0216 | 0.993032 | 7.918969 | 18.84779419 | 12.46787 | 6.649525 | 20.38684 | -1.53891 | 0.731253 |
| | 50.9939 | 1.492477 | 23.82059333 | 0.890012 | 10.69984 | 12.33539 | 13.21039 | 1.017242 | 7.621821 | 18.32140309 | 12.19232 | 7.016414 | 19.81294 | -1.49248 | 0.755543 |
| | 51.9939 | 1.436875 | 24.30330882 | 0.907466 | 10.46766 | 12.52008 | 13.39508 | 1.042077 | 7.31421 | 17.7818697 | 11.90454 | 7.420799 | 19.21875 | -1.43688 | 0.780277 |
| | 52.9939 | 1.371005 | 24.78671023 | 0.924919 | 10.23229 | 12.70072 | 13.57572 | 1.067323 | 6.99583 | 17.23911916 | 11.60329 | 7.879462 | 18.59012 | -1.371 | 0.805523 |
| | 53.9939 | 1.293529 | 25.25293068 | 0.942372 | 9.993802 | 12.87723 | 13.75223 | 1.093152 | 6.665048 | 16.68914948 | 11.28731 | 8.375501 | 17.95286 | -1.29351 | 0.831383 |
| | 54.9939 | 1.202604 | 25.7204369 | 0.959825 | 9.75227 | 13.04955 | 13.92455 | 1.119699 | 6.321523 | 16.0733928 | 10.95498 | 8.9465 | 17.27629 | -1.20269 | 0.8579 |
| | 55.9939 | 1.096391 | 26.18232529 | 0.977279 | 9.507769 | 13.21763 | 14.09263 | 1.147065 | 5.96189 | 15.45555816 | 10.60416 | 9.612271 | 16.58805 | -1.09639 | 0.885585 |
| | 56.1384 | 1.079594 | 26.25019428 | 0.9799 | 9.472202 | 13.24166 | 14.11666 | 1.151897 | 5.90655 | 15.36075192 | 10.5518 | 9.715565 | 16.46035 | -1.07959 | 0.889297 |
| | | | 26.25 | | | | | | | 19.38067 | | | | | |

FIG. 8A

| Step5 angle opposite of Gamma | Force in 2-3 (Not Correct) | Angle (atan(y/m)) | Additional Vertical force (acting with tucked) lbs | A | B | Slider Tube Moment | Bending Stress | Tube Deflection @ Slider | Tube Deflection Max A-B | Tube Deflection Max B-A | Y | Angle @ Pivot to 2-3 | Angle to Vertical | Angle 2-3 23-4 | b | Angle @ Caster to 2-4 | Distance Between AA & BB | Caster Leg to Vertical |
|---|---|---|---|---|---|---|---|---|---|---|---|---|---|---|---|---|---|---|
| 1.064 | 5460.029 | 0.245435 | 232.4727 | 1.895 | 33.605 | 590.6116 | 10212.03 | 0.003372 | | 0.012106 | 3.249103 | 0.602851 | 0.558251 | 0.24533 | 18.27304 | 1.323288 | 15.9 | 12.25414 |
| 1.028 | 5103.932 | 0.265016 | 214.9185 | 2.048863 | 35.45122 | 703.3021 | 10317.64 | 0.003739 | | 0.010465 | 3.578395 | 0.602851 | 0.488788 | 0.283104 | 18.3438 | 1.355955 | 15.9 | 12.00156 |
| 0.988 | 4792.958 | 0.286209 | 198.5216 | 2.213602 | 37.2862 | 712.9311 | 10459.11 | 0.004162 | | 0.01094 | 4.50242 | 0.602851 | 0.471345 | 0.32101 | 18.34269 | 1.340187 | 15.9 | 11.81459 |
| 0.950 | 4522.173 | 0.306815 | 185.8921 | 2.389416 | 39.11058 | 725.1601 | 10638.51 | 0.004548 | | 0.011055 | 5.12899 | 0.602851 | 0.453891 | 0.358969 | 18.37706 | 1.322971 | 15.9 | 11.63162 |
| 0.912 | 4282.806 | 0.327057 | 173.7285 | 2.578788 | 40.92421 | 738.5705 | 10849.92 | 0.005194 | | 0.012056 | 5.748915 | 0.602851 | 0.436438 | 0.385745 | 18.41374 | 1.305341 | 15.9 | 11.47152 |
| 0.874 | 4066.311 | 0.347470 | 162.706 | 2.777878 | 42.72712 | 755.8266 | 11088.45 | 0.00581 | | 0.012716 | 6.371022 | 0.602851 | 0.419385 | 0.414039 | 18.45 | 1.287306 | 15.9 | 11.33365 |
| 0.838 | 3877.805 | 0.367941 | 152.0077 | 2.966838 | 44.51886 | 773.867 | 11330.14 | 0.006498 | | 0.013436 | 6.990156 | 0.602851 | 0.402551 | 0.472555 | 18.48867 | 1.268885 | 15.9 | 11.21676 |
| 0.799 | 3704.908 | 0.388428 | 142.6139 | 3.149686 | 46.30966 | 792.8678 | 11631.68 | 0.007251 | | 0.014121 | 7.607018 | 0.602851 | 0.384078 | 0.510495 | 18.52371 | 1.250088 | 15.9 | 11.11992 |
| 0.761 | 3548.041 | 0.408943 | 135.8823 | 3.329088 | 48.07397 | 813.3127 | 11934.27 | 0.008102 | | 0.015064 | 8.221548 | 0.602851 | 0.365625 | 0.548464 | 18.56106 | 1.230931 | 15.9 | 11.04216 |
| 0.723 | 3407.516 | 0.429488 | 129.1429 | 3.507565 | 49.82243 | 834.558 | 12249.44 | 0.009025 | | 0.016068 | 8.833526 | 0.602851 | 0.349171 | 0.586462 | 18.59869 | 1.211477 | 15.9 | 10.9825 |
| 0.685 | 3278.418 | 0.449066 | 121.1827 | 3.677815 | 51.56238 | 856.7468 | 12568.01 | 0.010002 | | 0.017126 | 9.44278 | 0.602851 | 0.334265 | 0.624405 | 18.63651 | 1.191689 | 15.9 | 10.93999 |
| 0.645 | 3150.22 | 0.470684 | 114.2422 | 4.178133 | 53.32157 | 879.6472 | 12904.93 | 0.011124 | | 0.017946 | 10.04913 | 0.602851 | 0.322565 | 0.662505 | 18.67445 | 1.171432 | 15.9 | 10.91387 |
| 0.608 | 3051.042 | 0.491342 | 108.7629 | 4.44908 | 55.09092 | 903.1205 | 13249.26 | 0.012303 | | 0.01903 | 10.3524 | 0.602851 | 0.306812 | 0.700875 | 18.71259 | 1.150999 | 15.9 | 10.90250 |
| 0.570 | 2951.594 | 0.512045 | 103.195 | 4.700418 | 56.76998 | 927.0417 | 13600.23 | 0.013587 | | 0.02013 | 11.25243 | 0.602851 | 0.278358 | 0.739832 | 18.75074 | 1.130209 | 15.9 | 10.90579 |
| 0.532 | 2859.148 | 0.532797 | 97.99569 | 5.022104 | 58.47279 | 951.2866 | 13959.84 | 0.014915 | | 0.021293 | 11.84964 | 0.602851 | 0.261835 | 0.777037 | 18.7889 | 1.109158 | 15.9 | 10.92203 |
| 0.494 | 2773.503 | 0.553602 | 93.1293 | 5.324109 | 60.17569 | 975.7281 | 14314.5 | 0.016346 | | 0.022251 | 12.44207 | 0.602851 | 0.244452 | 0.815289 | 18.82701 | 1.087656 | 15.9 | 10.95125 |
| 0.456 | 2693.063 | 0.574408 | 88.56325 | 5.636398 | 61.85338 | 1000.239 | 14674.07 | 0.017852 | | 0.023283 | 13.03136 | 0.602851 | 0.226898 | 0.853913 | 18.86502 | 1.06529 | 15.9 | 10.99459 |
| 0.417 | 2619.944 | 0.595334 | 84.27029 | 5.958942 | 63.52148 | 1024.881 | 15032.55 | 0.019433 | | 0.024351 | 13.61875 | 0.602851 | 0.209545 | 0.891994 | 18.90288 | 1.044476 | 15.9 | 11.04237 |
| 0.379 | 2550.902 | 0.616139 | 80.22816 | 6.281214 | 65.18238 | 1049.913 | 15388.16 | 0.021077 | | 0.025369 | 14.19507 | 0.602851 | 0.192052 | 0.930444 | 18.94055 | 1.022428 | 15.9 | 11.10262 |
| 0.340 | 2486.381 | 0.637462 | 76.4097 | 6.604883 | 66.80531 | 1072.785 | 15738.37 | 0.022777 | | 0.027709 | 14.77510 | 0.602851 | 0.174639 | 0.968889 | 18.97797 | 1.000157 | 15.9 | 11.17133 |
| 0.301 | 2425.975 | 0.658910 | 72.8021 | 6.937895 | 68.51214 | 1096.135 | 16080.93 | 0.024522 | | 0.028095 | 15.34794 | 0.602851 | 0.157185 | 1.007578 | 19.0151 | 0.977875 | 15.9 | 11.24746 |
| 0.263 | 2369.322 | 0.679858 | 69.38584 | 7.281216 | 69.14879 | 1119.791 | 16413.3 | 0.026288 | | 0.030428 | 15.91618 | 0.602851 | 0.139732 | 1.046271 | 19.05168 | 0.954992 | 15.9 | 11.32564 |
| 0.224 | 2316.1 | 0.701197 | 66.14843 | 7.624752 | 71.77525 | 1143.865 | 16752.74 | 0.028166 | | 0.031788 | 16.47977 | 0.602851 | 0.122279 | 1.085004 | 19.09227 | 0.932123 | 15.9 | 11.41768 |
| 0.185 | 2266.019 | 0.722045 | 63.0745 | 8.169476 | 73.39152 | 1168.254 | 17096.26 | 0.029481 | | 0.033134 | 17.03558 | 0.602851 | 0.104825 | 1.123691 | 19.13421 | 0.908376 | 15.9 | 11.5285 |
| 0.146 | 2218.621 | 0.744189 | 60.1548 | 8.524407 | 75.00759 | 1193.339 | 17439.86 | 0.030852 | | 0.034454 | 17.58248 | 0.602851 | 0.087372 | 1.162372 | 19.17882 | 0.883577 | 15.9 | 11.6042 |
| 0.107 | 2174.27 | 0.765663 | 57.37007 | 8.866879 | 76.59542 | 1218.481 | 17788.4 | 0.032379 | | 0.035706 | 18.14934 | 0.602851 | 0.069919 | 1.202109 | 19.1946 | 0.862664 | 15.9 | 11.70047 |
| 0.068 | 2132.151 | 0.787703 | 54.7196 | 9.219028 | 78.17897 | 1244.508 | 18137.68 | 0.033941 | | 0.036958 | 18.68505 | 0.602851 | 0.052465 | 1.241368 | 19.22605 | 0.838594 | 15.9 | 11.79094 |
| 0.028 | 2092.288 | 0.808872 | 52.1912 | 9.579893 | 79.73412 | 1271.466 | 18502.3 | 0.035609 | | 0.038111 | 19.2235 | 0.602851 | 0.035012 | 1.282009 | 19.25268 | 0.813067 | 15.9 | 11.88211 |
| -0.011 | 2054.44 | 0.831806 | 49.77658 | 10.18107 | 81.31893 | 1299.312 | 18873.7 | 0.037378 | | 0.039173 | 19.75699 | 0.602851 | 0.017559 | 1.323392 | 19.29973 | 0.791623 | 15.9 | 11.98435 |
| -0.051 | 2018.456 | 0.85412 | 47.46818 | 10.82895 | 82.87315 | 1328.017 | 19250.88 | 0.039351 | | 0.040125 | 20.28427 | 0.602851 | 0.000106 | 1.36510 | 19.32808 | 0.767781 | 15.9 | 12.07789 |
| -0.091 | 1984.276 | 0.876633 | 45.25889 | 11.09331 | 84.41969 | 1354.502 | 19604.20 | 0.040461 | | 0.041043 | 20.80633 | 0.602851 | -0.01735 | 1.406126 | 19.35066 | 0.743857 | 15.9 | 12.15276 |
| -0.131 | 1951.827 | 0.899267 | 43.14204 | 11.55064 | 85.94935 | 1378.826 | 19935.86 | 0.041253 | | 0.041604 | 21.32284 | 0.602851 | -0.0348 | 1.446313 | 19.38045 | 0.719867 | 15.9 | 12.22474 |
| -0.172 | 1920.401 | 0.922345 | 41.11267 | 12.02906 | 87.47064 | 1394.833 | 19408.97 | 0.041991 | | 0.042082 | 21.83371 | 0.602851 | -0.05225 | 1.482744 | 19.42039 | 0.695633 | 15.9 | 12.28556 |
| -0.212 | 1890.45 | 0.945595 | 39.18293 | 12.51184 | 88.98116 | 1408.499 | 18316.2 | 0.042338 | | 0.042346 | 22.33891 | 0.602851 | -0.06973 | 1.521468 | 19.46345 | 0.67177 | 15.9 | 12.33177 |
| -0.253 | 1861.626 | 0.969152 | 37.28842 | 13.00032 | 90.47908 | 1237.126 | 18149.34 | 0.042339 | 0.042371 | | 22.83843 | 0.602851 | -0.08716 | 1.562458 | 19.47757 | 0.647709 | 15.9 | 12.38073 |
| -0.295 | 1833.773 | 0.993052 | 35.48417 | 13.52093 | 91.96602 | 1220.031 | 17899.25 | 0.042015 | 0.042123 | | 23.33229 | 0.602851 | -0.10464 | 1.603812 | 19.50473 | 0.623673 | 15.9 | 12.36843 |
| -0.337 | 1806.728 | 1.017042 | 33.74476 | 14.0402 | 93.44006 | 1196.87 | 17656.82 | 0.041271 | 0.041571 | | 23.82055 | 0.602851 | -0.12207 | 1.645585 | 19.53095 | 0.599695 | 15.9 | 12.35043 |
| -0.379 | 1780.34 | 1.042077 | 32.00516 | 14.59979 | 94.90221 | 1166.112 | 17107.53 | 0.040094 | 0.040886 | | 24.30331 | 0.602851 | -0.13952 | 1.687742 | 19.55344 | 0.575819 | 15.9 | 12.30141 |
| -0.421 | 1754.312 | 1.067522 | 30.44063 | 15.15354 | 96.34546 | 1127.93 | 16541.51 | 0.038453 | 0.039434 | | 24.78071 | 0.602851 | -0.15697 | 1.730442 | 19.57991 | 0.552084 | 15.9 | 12.21498 |
| -0.465 | 1728.493 | 1.093162 | 28.99473 | 15.72251 | 97.77467 | 1079.928 | 15843.17 | 0.036321 | 0.037779 | | 25.25258 | 0.602851 | -0.17443 | 1.773735 | 19.60275 | 0.528539 | 15.9 | 12.08334 |
| -0.509 | 1702.556 | 1.119699 | 27.33302 | 16.30807 | 99.19193 | 1022.172 | 14998.84 | 0.033681 | 0.035881 | | 25.72044 | 0.602851 | -0.19188 | 1.817725 | 19.62434 | 0.505255 | 15.9 | 11.86693 |
| -0.554 | 1676.127 | 1.147005 | 25.63587 | 16.912 | 100.5955 | 952.9587 | 13980.45 | 0.030523 | 0.033103 | | 26.18353 | 0.602851 | -0.20933 | 1.862444 | 19.5447 | 0.482315 | 15.9 | 11.64332 |
| -0.599 | 1672.241 | 1.151097 | 25.5257 | 17.0001 | 5.499069 | 941.526 | 13816.59 | 0.030024 | 0.032865 | | 26.2501 | 0.602851 | -0.21186 | 1.868969 | 19.64753 | 0.479008 | 15.9 | 11.60016 |

FIG. 8C

| | | | | | | | | | | | | | | | | | | | | | | | |
|---|---|---|---|---|---|---|---|---|---|---|---|---|---|---|---|---|---|---|---|---|---|---|---|
| | | | | | Gamma | X (s-z) | Y | Gam, Rad | z | H | R + dy | Alpha Rad | g | c | a | w | R-hbc | Difference | Distance between Supports | R1 (Head) | R2 (Foot) |
| | | | | | | | 0.000014 | | | | | | | -0.00019 | | | | | | | | | |
| a | 14.5 | 0 | | | 14.9939 | 0.328354 | 3.249103 | 0.281094 | 10.4212 | 3.523189 | 4.366159 | 0.245435 | 14.05946 | 30.40888 | 16.74776 | 1.085906 | 30.81322 | -0.32055 | 66.02943 | 320 | 320 |
| tr | 17 | 0 | | | 16.4929 | 0.357403 | 3.622906 | 0.27042 | 16.3922 | 3.855322 | 4.541322 | 0.255625 | 14.02663 | 30.41103 | 16.74958 | 1.132979 | 30.77851 | -0.39748 | 65.11129 | 320 | 320 |
| d | 16.25 | 0 | | | 15.9939 | 0.349821 | 3.376385 | 0.278147 | 16.34194 | 3.809109 | 4.684168 | 0.255518 | 13.99974 | 30.32266 | 16.74866 | 1.180364 | 30.7605 | -0.40762 | 65.19217 | 320 | 320 |
| tw | 0.261799 | 15 Degrees | | 0 | 16.4929 | 0.442563 | 4.296578 | 0.267674 | 16.30445 | 4.664539 | 4.826239 | 0.276011 | 13.95118 | 30.23162 | 16.74851 | 1.22791 | 30.69849 | -0.44726 | 65.27205 | 320 | 320 |
| | | | | | 16.9939 | 0.437324 | 4.242862 | 0.2866 | 16.25771 | 4.593569 | 4.966602 | 0.285288 | 13.91918 | 30.18766 | 16.74901 | 1.275566 | 30.65517 | -0.4878 | 65.35093 | 320 | 320 |
| dy | 0.875 | 0 | | | 17.4929 | 0.529241 | 4.614898 | 0.306027 | 16.21373 | 4.235290 | 5.110206 | 0.29641 | 13.88767 | 30.0814 | 16.75097 | 1.324037 | 30.60764 | -0.52624 | 65.42661 | 320 | 320 |
| | | | | | 17.9939 | 0.584667 | 5.12589 | 0.314094 | 16.16652 | 4.370581 | 5.253581 | 0.308815 | 13.82373 | 29.99225 | 16.75316 | 1.372527 | 30.56600 | -0.56457 | 65.50588 | 320 | 320 |
| | | | | | 18.4929 | 0.602578 | 5.428672 | 0.32278 | 16.12207 | 4.517476 | 5.392476 | 0.316824 | 13.77035 | 29.9004 | 16.72485 | 1.42138 | 30.52290 | -0.60250 | 65.58148 | 320 | 320 |
| | | | | | 18.9939 | 0.638969 | 5.749919 | 0.331507 | 16.0744 | 4.657569 | 5.532969 | 0.329857 | 13.73147 | 29.81550 | 16.71437 | 1.470589 | 30.46584 | -0.65997 | 65.65528 | 320 | 320 |
| | | | | | 19.4929 | 0.675824 | 6.060711 | 0.340234 | 16.0255 | 4.798024 | 5.673024 | 0.337255 | 13.66316 | 29.70867 | 16.70234 | 1.520152 | 30.3855 | -0.67663 | 65.72399 | 320 | 320 |
| | | | | | 19.9939 | 0.713169 | 6.371022 | 0.34696 | 15.97539 | 4.937655 | 5.812655 | 0.347478 | 13.5934 | 29.60879 | 16.68856 | 1.570159 | 30.32198 | -0.75517 | 65.80988 | 320 | 320 |
| | | | | | 20.4929 | 0.748968 | 6.680632 | 0.357887 | 15.92408 | 5.076844 | 5.951844 | 0.357707 | 13.58218 | 29.50624 | 16.67302 | 1.620449 | 30.28821 | -0.74897 | 65.87426 | 320 | 320 |
| | | | | | 20.9939 | 0.784225 | 6.990110 | 0.369414 | 15.87151 | 5.215579 | 6.090578 | 0.367941 | 13.52951 | 29.40102 | 16.65674 | 1.671211 | 30.18525 | -0.78422 | 65.94177 | 320 | 320 |
| | | | | | 21.4929 | 0.816934 | 7.299862 | 0.37514 | 15.84778 | 5.35385 | 6.22885 | 0.378181 | 13.4754 | 29.29395 | 16.63669 | 1.722407 | 30.11259 | -0.81803 | 66.01419 | 320 | 320 |
| Actuator Speed= (.12/1350)*load+.28 | | | | | 21.9939 | 0.850393 | 7.607018 | 0.383867 | 15.7928 | 5.491647 | 6.366647 | 0.388429 | 13.41903 | 29.18583 | 16.61585 | 1.774053 | 30.03572 | -0.85096 | 66.0825 | 320 | 320 |
| | | | | | 22.4929 | 0.866695 | 7.914591 | 0.392502 | 15.70984 | 5.628859 | 6.503859 | 0.398682 | 13.36281 | 29.06945 | 16.59132 | 1.82017 | 29.95814 | -0.88868 | 66.14969 | 320 | 320 |
| Empty Bed Weight= | | | | 140 | 22.9939 | 0.910714 | 8.221548 | 0.40132 | 15.64928 | 5.765779 | 6.640779 | 0.409943 | 13.30435 | 28.95364 | 16.569 | 1.878775 | 29.87335 | -0.91971 | 66.21575 | 320 | 320 |
| Distributed Load= | | | | 300 | 23.4939 | 0.95217 | 8.527968 | 0.410047 | 15.59074 | 5.902088 | 6.777888 | 0.419212 | 13.24445 | 28.83210 | 16.04291 | 1.931302 | 29.78205 | -0.95217 | 66.28087 | 320 | 320 |
| Concentrated Load= | | | | 0 | 23.9939 | 0.984047 | 8.833528 | 0.418773 | 15.531 | 6.037803 | 6.912803 | 0.429488 | 13.18056 | 28.7143 | 16.54525 | 1.985833 | 29.68814 | -0.98405 | 66.34449 | 320 | 320 |
| Distance Concentrated Load to CG= | | | | 35 | 24.4939 | 1.015337 | 9.138505 | 0.4275 | 15.47009 | 6.173151 | 7.048151 | 0.439774 | 13.1203 | 28.59038 | 16.48545 | 2.039737 | 29.60572 | -1.01534 | 66.407 | 320 | 320 |
| | | | | | 24.9939 | 1.046033 | 9.44278 | 0.436227 | 15.40788 | 6.307883 | 7.182883 | 0.450068 | 13.06696 | 28.46405 | 16.45402 | 2.094511 | 29.53008 | -1.04603 | 66.46859 | 320 | 320 |
| | | | | | 25.4939 | 1.076139 | 9.746326 | 0.444955 | 15.34472 | 6.442068 | 7.317068 | 0.460371 | 12.99037 | 28.33303 | 16.42085 | 2.149883 | 29.45122 | -1.07613 | 66.52898 | 320 | 320 |
| | | | | | 25.9939 | 1.105615 | 10.04913 | 0.45368 | 15.28029 | 6.575696 | 7.450696 | 0.470684 | 12.92324 | 28.20150 | 16.3958 | 2.205277 | 29.36914 | -1.10562 | 66.58756 | 320 | 320 |
| | | | | | 26.4939 | 1.134486 | 10.35116 | 0.462407 | 15.21499 | 6.706756 | 7.583756 | 0.481009 | 12.85457 | 28.06636 | 16.34917 | 2.262519 | 29.30384 | -1.13449 | 66.6403 | 320 | 320 |
| | | | | | 26.9939 | 1.162731 | 10.6524 | 0.471135 | 15.14783 | 6.841238 | 7.718238 | 0.491342 | 12.78466 | 27.93158 | 16.31008 | 2.319933 | 29.08551 | -1.16273 | 66.70119 | 320 | 320 |
| | | | | | 27.4939 | 1.190343 | 10.95283 | 0.47986 | 15.08001 | 6.973134 | 7.849134 | 0.501587 | 12.7132 | 27.79023 | 16.27036 | 2.377849 | 28.98205 | -1.19034 | 66.75701 | 320 | 320 |
| | | | | | 27.9939 | 1.217244 | 11.25243 | 0.488587 | 15.01365 | 7.104431 | 7.979431 | 0.512046 | 12.64003 | 27.65125 | 16.22827 | 2.436564 | 28.88555 | -1.21731 | 66.81055 | 320 | 320 |
| | | | | | 28.4939 | 1.243634 | 11.55147 | 0.497313 | 14.94075 | 7.235121 | 8.110121 | 0.522414 | 12.56595 | 27.50859 | 16.18436 | 2.495968 | 28.78003 | -1.24363 | 66.85339 | 320 | 320 |
| | | | | | 28.9939 | 1.269204 | 11.84004 | 0.50604 | 14.86841 | 7.365153 | 8.240153 | 0.532797 | 12.49015 | 27.35956 | 16.1387 | 2.556332 | 28.62885 | -1.26925 | 66.89491 | 320 | 320 |
| | | | | | 29.4939 | 1.294284 | 12.14802 | 0.514767 | 14.79693 | 7.494638 | 8.369638 | 0.543182 | 12.41291 | 27.20984 | 16.08121 | 2.617508 | 28.60413 | -1.29428 | 66.95469 | 320 | 320 |
| | | | | | 29.9939 | 1.318594 | 12.44207 | 0.523493 | 14.72368 | 7.623446 | 8.498446 | 0.553602 | 12.33422 | 27.06766 | 16.04192 | 2.679348 | 28.37618 | -1.31889 | 67.01351 | 320 | 320 |
| | | | | | 30.4939 | 1.342215 | 12.7372 | 0.53222 | 14.64901 | 7.751605 | 8.626605 | 0.563027 | 12.25409 | 26.92085 | 16.00082 | 2.742343 | 28.24401 | -1.34221 | 67.06076 | 320 | 320 |
| | | | | | 30.9939 | 1.365135 | 13.03135 | 0.540946 | 14.57277 | 7.878108 | 8.753108 | 0.574606 | 12.1725 | 26.74626 | 15.9579 | 2.805184 | 28.1104 | -1.36513 | 67.1066 | 320 | 320 |
| | | | | | 31.4939 | 1.387343 | 13.32455 | 0.549673 | 14.49502 | 8.003945 | 8.880945 | 0.584922 | 12.08945 | 26.56527 | 15.88316 | 2.870669 | 27.97202 | -1.38734 | 67.15101 | 320 | 320 |
| | | | | | 31.9939 | 1.408928 | 13.61075 | 0.5584 | 14.41777 | 8.128205 | 9.007105 | 0.595394 | 12.00495 | 26.42272 | 15.8205 | 2.936688 | 27.82155 | -1.40893 | 67.18398 | 320 | 320 |
| | | | | | 32.4939 | 1.429579 | 13.90793 | 0.567126 | 14.33902 | 8.251579 | 9.132579 | 0.605868 | 11.91989 | 26.25761 | 15.7582 | 3.003475 | 27.66749 | -1.42958 | 67.21549 | 320 | 320 |
| | | | | | 32.9939 | 1.449581 | 14.19807 | 0.575853 | 14.25838 | 8.372358 | 9.257358 | 0.616039 | 11.83157 | 26.09995 | 15.70786 | 3.071385 | 27.53653 | -1.44958 | 67.27549 | 320 | 320 |
| | | | | | 33.4939 | 1.468823 | 14.46717 | 0.58456 | 14.17705 | 8.490431 | 9.381431 | 0.628917 | 11.74288 | 25.91973 | 15.64367 | 3.140444 | 27.36596 | -1.46882 | 67.31397 | 320 | 320 |
| | | | | | 33.9939 | 1.48728 | 14.77518 | 0.593336 | 14.09484 | 8.629751 | 9.504791 | 0.637452 | 11.65233 | 25.74687 | 15.58193 | 3.210662 | 27.23426 | -1.48728 | 67.35031 | 320 | 320 |
| | | | | | 34.4939 | 1.504969 | 15.06211 | 0.602033 | 14.01118 | 8.752426 | 9.627426 | 0.648028 | 11.55948 | 25.57156 | 15.51613 | 3.282165 | 27.07663 | -1.50497 | 67.38328 | 320 | 320 |
| | | | | | 34.9939 | 1.521845 | 15.34784 | 0.61076 | 13.92851 | 8.874329 | 9.749329 | 0.658616 | 11.46718 | 25.3938 | 15.44948 | 3.354809 | 26.91564 | -1.52185 | 67.42002 | 320 | 320 |
| | | | | | 35.4939 | 1.537903 | 15.63263 | 0.619466 | 13.84101 | 8.999488 | 9.874488 | 0.669225 | 11.37238 | 25.21339 | 15.37891 | 3.429132 | 26.7513 | -1.5379 | 67.45213 | 320 | 320 |
| | | | | | 35.9939 | 1.553227 | 15.91618 | 0.628213 | 13.75434 | 9.115897 | 9.990897 | 0.679256 | 11.2761 | 25.03044 | 15.30747 | 3.504735 | 26.58357 | -1.55323 | 67.48256 | 320 | 320 |
| | | | | | 36.4939 | 1.5675 | 16.19856 | 0.63694 | 13.66669 | 9.230534 | 10.11534 | 0.690516 | 11.17832 | 24.84488 | 15.23613 | 3.581766 | 26.41245 | -1.5675 | 67.51132 | 320 | 320 |
| | | | | | 36.9939 | 1.581033 | 16.47977 | 0.645666 | 13.57798 | 9.344421 | 10.22942 | 0.701197 | 11.07903 | 24.65601 | 15.15568 | 3.660082 | 26.23799 | -1.581 | 67.53833 | 320 | 320 |
| | | | | | 37.4939 | 1.59362 | 16.75878 | 0.654355 | 13.4881 | 9.47252 | 10.34752 | 0.711806 | 10.97922 | 24.46682 | 15.08172 | 3.740629 | 26.05904 | -1.59362 | 67.56357 | 320 | 320 |
| | | | | | 37.9939 | 1.606033 | 17.03838 | 0.663118 | 13.39728 | 9.598993 | 10.47493 | 0.722341 | 10.8759 | 24.27315 | 15.00262 | 3.822582 | 25.87632 | -1.60603 | 67.58699 | 320 | 320 |
| | | | | | 38.4939 | 1.618114 | 17.31616 | 0.671846 | 13.30546 | 9.706344 | 10.58134 | 0.733405 | 10.77204 | 24.0775 | 14.92157 | 3.906326 | 25.69361 | -1.61811 | 67.60855 | 320 | 320 |
| | | | | | 38.9939 | 1.629589 | 17.59248 | 0.680573 | 13.21281 | 9.812051 | 10.69705 | 0.744189 | 10.66666 | 23.87926 | 14.83856 | 3.991969 | 25.50591 | -1.62959 | 67.62823 | 320 | 320 |
| | | | | | 39.4939 | 1.640415 | 17.86755 | 0.689299 | 13.11675 | 9.906644 | 10.81194 | 0.755024 | 10.55999 | 23.67845 | 14.75358 | 4.078653 | 25.31327 | -1.64042 | 67.64596 | 320 | 320 |
| | | | | | 39.9939 | 1.650587 | 18.14134 | 0.698026 | 13.02281 | 10.00101 | 10.92601 | 0.765883 | 10.45118 | 23.47908 | 14.6666 | 4.168229 | 25.11777 | -1.65059 | 67.6617 | 320 | 320 |
| | | | | | 40.4939 | 1.660038 | 18.41365 | 0.706753 | 12.92837 | 10.18425 | 11.03925 | 0.776775 | 10.34008 | 23.28915 | 14.57781 | 4.260367 | 24.91863 | -1.66004 | 67.6754 | 320 | 320 |
| | | | | | 40.9939 | 1.668347 | 18.68505 | 0.715479 | 12.83128 | 10.27685 | 11.13185 | 0.787703 | 10.22036 | 23.08863 | 14.48659 | 4.355245 | 24.71598 | -1.66835 | 67.68702 | 320 | 320 |

FIG. 9A

| | | | | | | | | | | | | | | | | |
|---|---|---|---|---|---|---|---|---|---|---|---|---|---|---|---|---|
| 41.4939 | 1.660081 | 18.95494 | 0.724206 | 12.73344 | 10.3882 | 11.2632 | 0.798668 | 10.1161 | 22.84953 | 14.39352 | 4.451827 | 24.50961 | -1.66008 | 67.69649 | 320 | 320 |
| 41.9939 | 1.663714 | 19.2235 | 0.732933 | 12.63466 | 10.49889 | 11.37389 | 0.809672 | 10.00117 | 22.63583 | 14.29838 | 4.550965 | 24.29955 | -1.66371 | 67.70375 | 320 | 320 |
| 42.4939 | 1.666213 | 19.49072 | 0.741659 | 12.53493 | 10.60871 | 11.48371 | 0.820718 | 9.884598 | 22.41953 | 14.20114 | 4.652802 | 24.08574 | -1.66621 | 67.70875 | 320 | 320 |
| 42.9939 | 1.667546 | 19.75659 | 0.750386 | 12.43424 | 10.71766 | 11.59266 | 0.831806 | 9.76636 | 22.2006 | 14.10178 | 4.757494 | 23.86814 | -1.66755 | 67.71142 | 320 | 320 |
| 43.4939 | 1.667677 | 20.02109 | 0.759113 | 12.3326 | 10.82573 | 11.70073 | 0.842939 | 9.646433 | 21.97903 | 14.00028 | 4.865207 | 23.64671 | -1.66768 | 67.71168 | 320 | 320 |
| 43.9939 | 1.666569 | 20.28422 | 0.767839 | 12.23002 | 10.9329 | 11.8079 | 0.85412 | 9.524793 | 21.75482 | 13.89659 | 4.976121 | 23.42139 | -1.66657 | 67.70946 | 320 | 320 |
| 44.4939 | 1.664183 | 20.54597 | 0.776566 | 12.12652 | 11.03918 | 11.91418 | 0.86535 | 9.401414 | 21.52793 | 13.7907 | 5.090431 | 23.19211 | -1.66418 | 67.70469 | 320 | 320 |
| 44.9939 | 1.660476 | 20.80633 | 0.785293 | 12.02208 | 11.14455 | 12.01955 | 0.876633 | 9.276266 | 21.29835 | 13.68256 | 5.208351 | 22.95883 | -1.66048 | 67.69728 | 320 | 320 |
| 45.4939 | 1.655403 | 21.06529 | 0.794019 | 11.91674 | 11.249 | 12.124 | 0.887971 | 9.149318 | 21.06606 | 13.57214 | 5.33011 | 22.72146 | -1.6554 | 67.68713 | 320 | 320 |
| 45.9939 | 1.648915 | 21.32284 | 0.802746 | 11.81048 | 11.35253 | 12.22753 | 0.899367 | 9.020537 | 20.83102 | 13.4594 | 5.455962 | 22.47994 | -1.64892 | 67.67416 | 320 | 320 |
| 46.4939 | 1.64096 | 21.57898 | 0.811472 | 11.70333 | 11.45513 | 12.33013 | 0.910823 | 8.889884 | 20.59321 | 13.34429 | 5.58618 | 22.23417 | -1.64096 | 67.65825 | 320 | 320 |
| 46.9939 | 1.631483 | 21.83371 | 0.820199 | 11.59529 | 11.55679 | 12.43179 | 0.922345 | 8.757319 | 20.3526 | 13.22677 | 5.721067 | 21.98409 | -1.63148 | 67.63929 | 320 | 320 |
| 47.4939 | 1.620422 | 22.08702 | 0.828926 | 11.48636 | 11.6575 | 12.5325 | 0.933934 | 8.622799 | 20.10916 | 13.10678 | 5.860954 | 21.72958 | -1.62042 | 67.61717 | 320 | 320 |
| 47.9939 | 1.607714 | 22.33891 | 0.837652 | 11.37655 | 11.75726 | 12.63226 | 0.945595 | 8.486273 | 19.86283 | 12.98427 | 6.006206 | 21.47054 | -1.60771 | 67.59175 | 320 | 320 |
| 48.4939 | 1.593287 | 22.58938 | 0.846379 | 11.26589 | 11.85606 | 12.73106 | 0.957333 | 8.347688 | 19.61357 | 12.85917 | 6.157226 | 21.20686 | -1.59329 | 67.5629 | 320 | 320 |
| 48.9939 | 1.577067 | 22.83843 | 0.855106 | 11.15436 | 11.95388 | 12.82888 | 0.969152 | 8.206987 | 19.36135 | 12.73143 | 6.314462 | 20.93841 | -1.57707 | 67.53046 | 320 | 320 |
| 49.4939 | 1.55897 | 23.08607 | 0.863832 | 11.04198 | 12.05074 | 12.92574 | 0.981056 | 8.064104 | 19.10609 | 12.60095 | 6.47841 | 20.66506 | -1.55897 | 67.49426 | 320 | 320 |
| 49.9939 | 1.538906 | 23.33229 | 0.872559 | 10.92876 | 12.1466 | 13.0216 | 0.993052 | 7.918969 | 18.84773 | 12.46767 | 6.649625 | 20.38664 | -1.53891 | 67.45414 | 320 | 320 |
| 50.4939 | 1.516777 | 23.57712 | 0.881286 | 10.81472 | 12.24148 | 13.11648 | 1.005145 | 7.771504 | 18.58622 | 12.33149 | 6.828727 | 20.103 | -1.51678 | 67.40988 | 320 | 320 |
| 50.9939 | 1.492477 | 23.82055 | 0.890012 | 10.69984 | 12.33535 | 13.21035 | 1.017342 | 7.621621 | 18.32146 | 12.19232 | 7.016414 | 19.81394 | -1.49248 | 67.36128 | 320 | 320 |
| 51.4939 | 1.465886 | 24.06261 | 0.898739 | 10.58415 | 12.42822 | 13.30322 | 1.02965 | 7.469225 | 18.05338 | 12.05004 | 7.213474 | 19.51927 | -1.46589 | 67.3081 | 320 | 320 |
| 51.9939 | 1.436875 | 24.30331 | 0.907466 | 10.46766 | 12.52008 | 13.39508 | 1.042077 | 7.31421 | 17.78187 | 11.90454 | 7.420799 | 19.21875 | -1.43688 | 67.25008 | 320 | 320 |
| 52.4939 | 1.405301 | 24.54267 | 0.916192 | 10.35037 | 12.61091 | 13.48591 | 1.054631 | 7.156456 | 17.50682 | 11.75567 | 7.639406 | 18.91213 | -1.4053 | 67.18693 | 320 | 320 |
| 52.9939 | 1.371004 | 24.78071 | 0.924919 | 10.23229 | 12.70072 | 13.57572 | 1.067323 | 6.99583 | 17.22812 | 11.60329 | 7.870462 | 18.59912 | -1.371 | 67.11833 | 320 | 320 |
| 53.4939 | 1.333806 | 25.01747 | 0.933646 | 10.11343 | 12.7895 | 13.6645 | 1.080162 | 6.832183 | 16.94561 | 11.44724 | 8.115309 | 18.27942 | -1.33381 | 67.04394 | 320 | 320 |
| 53.9939 | 1.293509 | 25.25298 | 0.942372 | 9.993802 | 12.87723 | 13.75223 | 1.093162 | 6.665348 | 16.65915 | 11.28731 | 8.375501 | 17.95266 | -1.29351 | 66.96334 | 320 | 320 |
| 54.4939 | 1.249889 | 25.48729 | 0.951099 | 9.873412 | 12.96392 | 13.83892 | 1.106336 | 6.495133 | 16.36854 | 11.1233 | 8.652854 | 17.61843 | -1.24989 | 66.8761 | 320 | 320 |
| 54.9939 | 1.202694 | 25.72044 | 0.959825 | 9.75227 | 13.04955 | 13.92455 | 1.119699 | 6.321323 | 16.07359 | 10.95496 | 8.9495 | 17.27629 | -1.20269 | 66.78171 | 320 | 320 |
| 55.4939 | 1.151638 | 25.95249 | 0.968552 | 9.630386 | 13.13413 | 14.00913 | 1.133269 | 6.14367 | 15.77406 | 10.78202 | 9.267966 | 16.92569 | -1.15164 | 66.6796 | 320 | 320 |
| 55.9939 | 1.096391 | 26.18353 | 0.977279 | 9.507768 | 13.21763 | 14.09263 | 1.147065 | 5.96189 | 15.46966 | 10.60416 | 9.611271 | 16.56605 | -1.09639 | 66.56911 | 320 | 320 |
| 56.1385 | 1.079587 | 26.25013 | 0.979801 | 9.472186 | 13.24157 | 14.11657 | 1.151098 | 5.908527 | 15.38071 | 10.55177 | 9.71564 | 16.4603 | -1.07959 | 66.5355 | 320 | 320 |

FIG. 9B

FIG. 9C

KINEMATIC MOTION OF ARTICULATED BED

CROSS-REFERENCE TO RELATED APPLICATIONS

This application claims the benefit of U.S. Provisional Patent Application No. 60/154,154, filed on Sep. 15, 1999.

BACKGROUND OF THE INVENTION

This invention relates in general to beds and in particular, to beds of the type that articulate to change the orientation of the sleep surface. Most particularly, the invention relates to the kinematic motion of articulated beds.

Articulated beds are well known. A conventional articulated bed includes a sleep surface supported by a main frame. The main frame is supported by a pair of opposing legs. A typical sleep surface includes a head section, a foot section, and a knee section between the head and foot sections. The head and knee sections are pivotally supported by a main frame so that they may be raised and lowered relative to the main frame. The foot section is pivotally connected to the knee section so that it moves in response to movement of the knee section. In addition to the sleep surface being movable, the legs of the bed are movable. Movement of the legs changes the orientation of the main frame by raising, lowering, or tilting the main frame.

The physical structure of the articulated bed limits its ability to achieve desired minimum and maximum elevations. For example, forces acting upon the legs are greatest when the bed first begins to rise from its lowest position. These forces resist movement of the legs if the angular disposition of the legs is too great. As the legs come closer to being horizontal when the bed is in its lowered position, a greater amount of force is required to start the legs in motion to raise the bed. The force can become so great that an affordable mechanical means for displacing the legs could be ineffective.

What is needed is a low-cost structure for an articulated bed that minimizes the amount of force required to raise the bed from its lowered position.

SUMMARY OF THE INVENTION

The present invention is directed towards a low-cost structure for an articulated bed which minimizes the elevation of the bed when in a lowered position and maximizes the elevation of the bed when in a raised position while minimizing the amount in which the bed creeps and further while maximizing leverage and minimizing force required to raise the bed from its lowered position. The articulated bed comprises a main frame supported by a leg tube. An upper portion of the leg tube is longitudinally and pivotally displaceable relative to the main frame at an upper movable pivot point. A lower portion of a stabilizer is connected to a lower intermediate portion of the leg tube at a lower orbital pivot point. An upper portion of the stabilizer is pivotally connected relative to the main frame at an upper fixed pivot point. A wheel is pivotally attached to a lower portion of the leg tube at a pivot axis. The upper movable pivot point, the lower orbital pivot point, and the pivot axis do not coalign and the distance between the upper fixed pivot point and the upper movable pivot point are maximized when the main frame is in a raised position.

Various objects and advantages of this invention will become apparent to those skilled in the art from the following detailed description of the preferred embodiment, when read in light of the accompanying drawings.

DESCRIPTION OF THE DRAWINGS

FIGS. 8A–8C are tables representing the results of a goal seeking operation relating to general loads and geometry of the bed.

FIGS. 9A–9D are tables representing the results of a goal seeking operation relating to actuator speeds.

DETAILED DESCRIPTION

Figure 1:
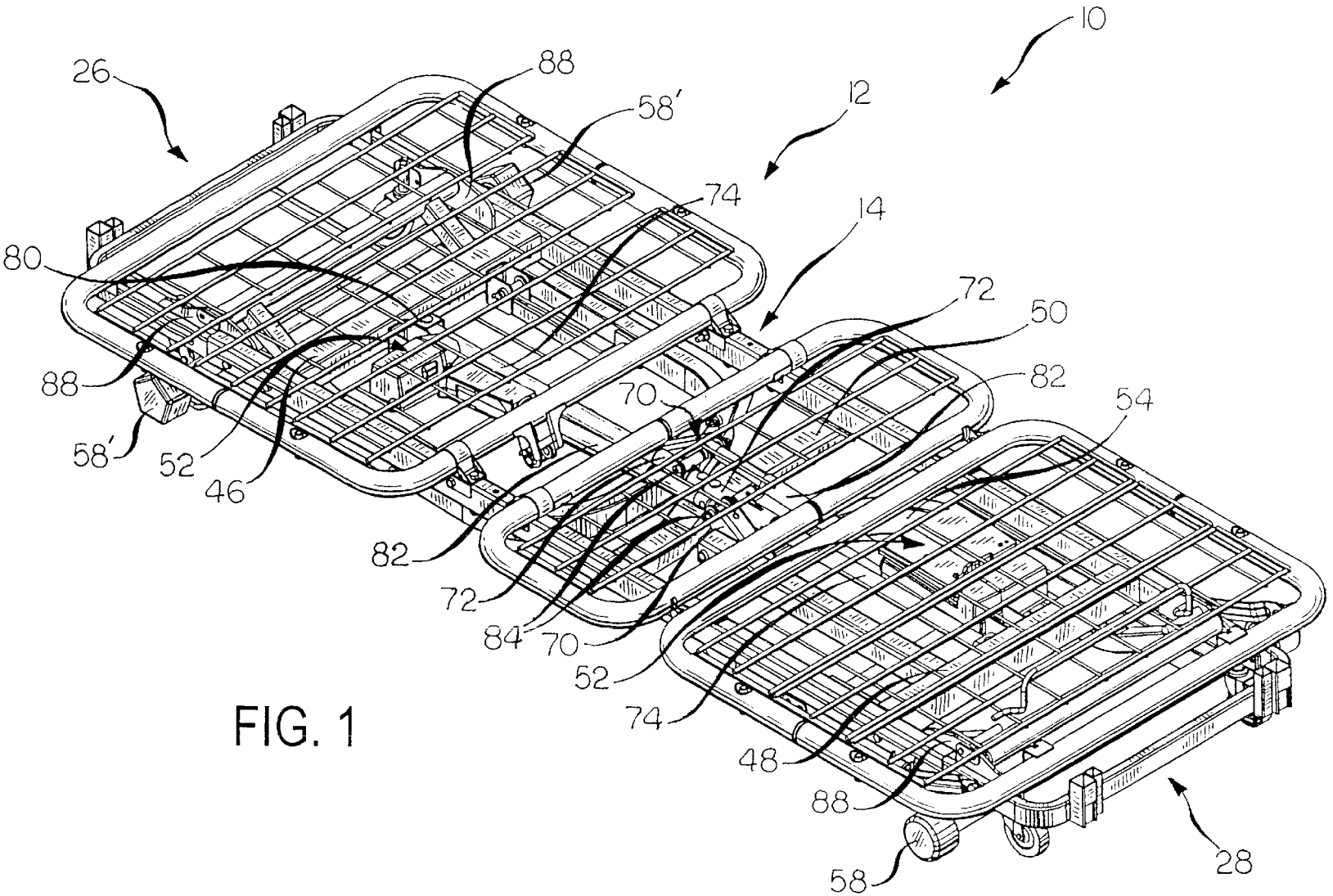
FIG. 1 is a perspective view of an articulated bed in a lowered position.
Figure 2:
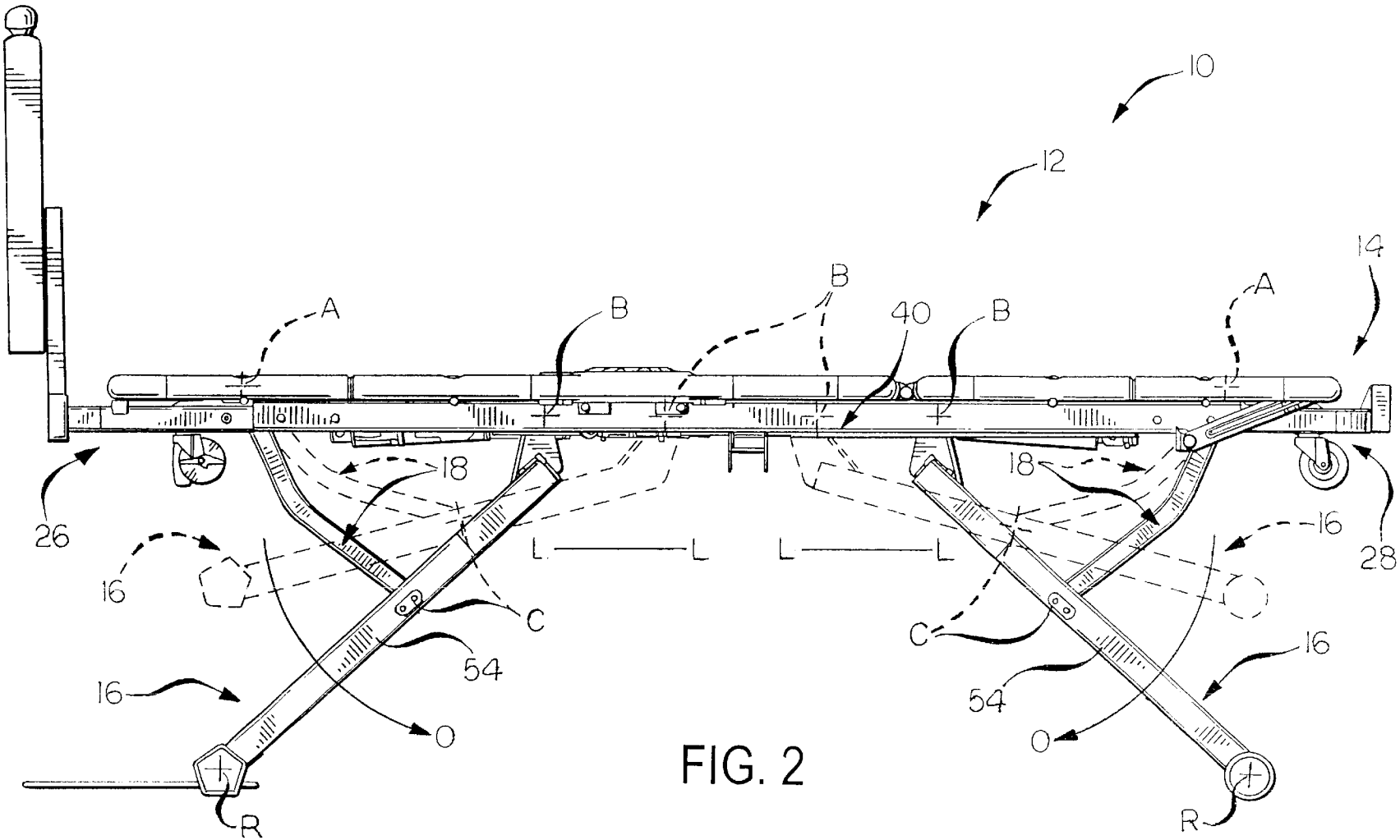
FIG. 2 is a side elevational view of an articulated bed in a raised position shown in full and further shown in a lowered position in phantom lines.

There is illustrated in FIGS. 1–2 a bed 10 comprising a sleep surface 12 supported by a main frame 14. The main frame 14 is supported by a pair of opposing legs 16 and corresponding stabilizers 18. The legs 16 and the stabilizers 18 are located primarily below the main frame 14 to provide subjacent support for the main frame 14. As will become more apparent in the description that follows, the legs 16 and the stabilizers 18 are pivotally attached to the main frame 14 and one another so as to be movable relative to the main frame 14 and one another. The legs 16 and the stabilizers 18 are movable to permit the elevation of the main frame 14 to be varied relative to a supporting surface. The entire main frame 14 may be lowered or raised relative to a supporting surface by raising and lowering the head and foot ends 26, 28 of the main frame 14. Alternatively, the head or foot ends 26, 28 of the main frame 14 may be lowered or raised to elevate the main frame 14 at an angle relative to a supporting surface.

Figure 3:
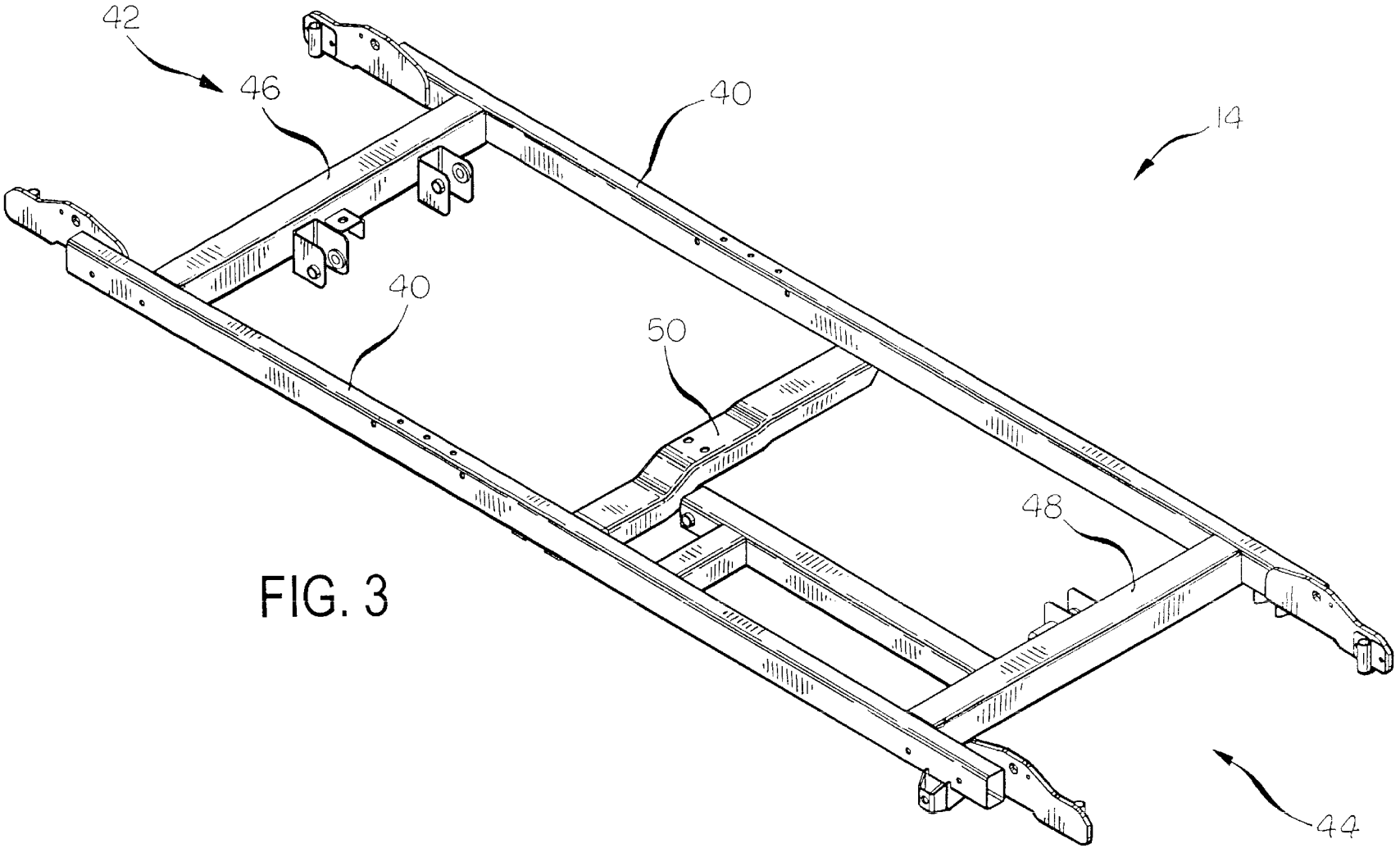
FIG. 3 is a perspective view of the main frame shown in FIGS. 1 and 2.
Figure 4:
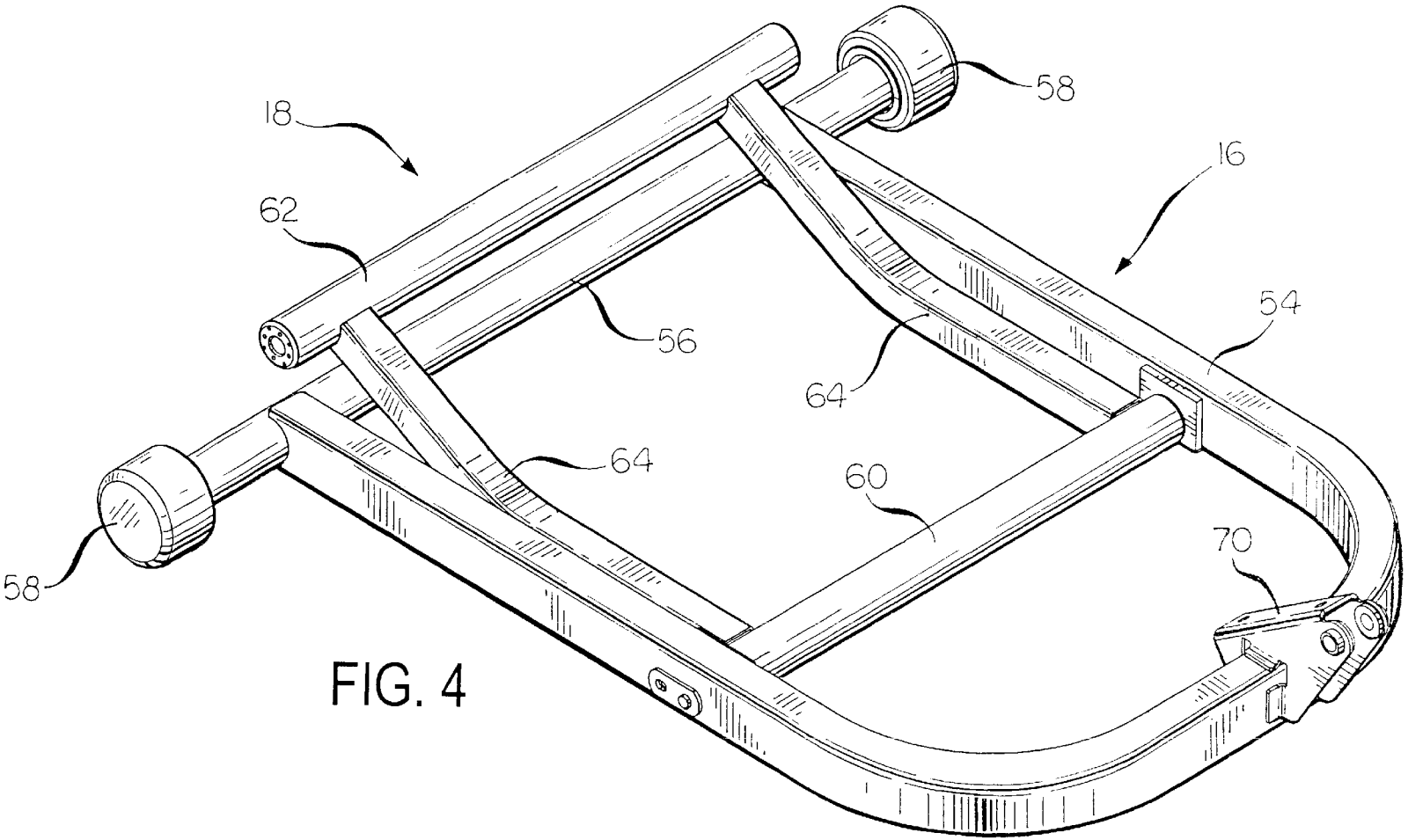
FIG. 4 is a perspective view of a leg and a stabilizer shown in FIG. 2.

The main frame 14, as shown in FIG. 3, includes opposing side rails 40 that have a head end 42 and a foot end 44 joined together by head and foot tubes 46, 48. The legs 16, as shown in FIG. 4, each includes an upper bent leg tube 54 and a lower laterally extending foot tube 56. The foot tube 56 may be attached to opposing legs of the bent leg tube 54. The lateral extent of the foot tubes 56 may exceed the width of the bent leg tubes 54 for attachment of wheels, such as the conventional and pentagonal shaped wheels 58, 58' shown. The stabilizers 18 each includes a short pivot tube 60 and a long pivot tube 62 joined together by laterally spaced stabilizer leg tubes 64. The short pivot tubes 60 are preferably dimensioned to fit between the legs of the bent leg tubes 56. The long pivot tubes 62 are dimensioned to fit between the stabilizer brackets 88 mounted to the side rails 40 of the main frame 14.

An upper portion of each bent leg tube 54 is longitudinally and pivotally displaceable relative to the main frame 14 at a first, or upper movable pivot point, designated at B in FIG. 2. A lower intermediate portion of each bent leg tube 54 is pivotally connected to a lower portion of a corresponding stabilizer 18, such as the short pivot tube 60, at a second, or lower orbital, pivot point designated at C in FIG. 2. An upper portion of each stabilizer 18, such as the long pivot tube 62, in turn, is pivotally connected to a corresponding stabilizer bracket 88 at a third, or upper fixed, pivot point designated at A in FIG. 2.

Figure 5:
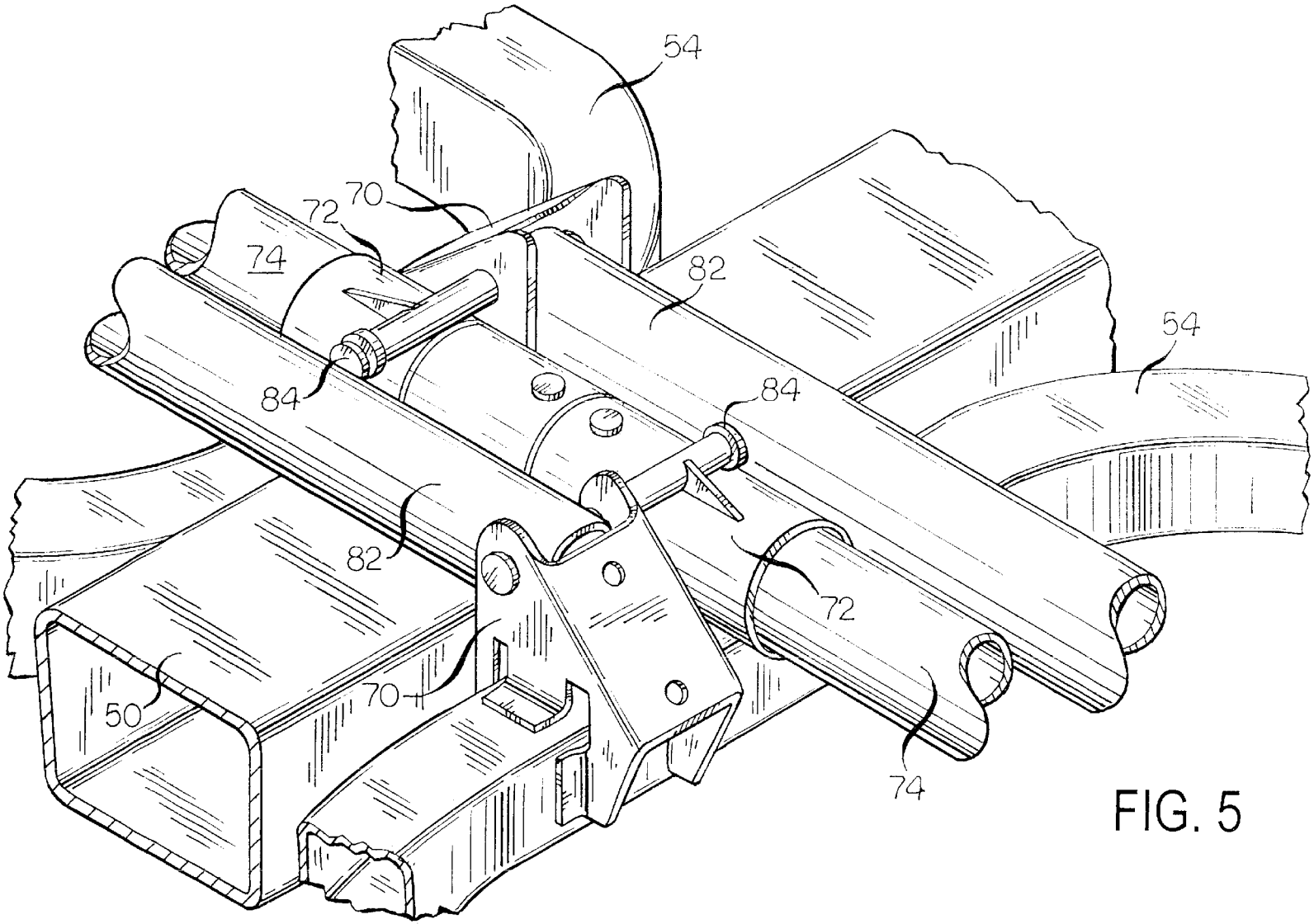
FIG. 5 is an enlarged perspective view of a movable pivot connection between the leg and the main frame shown in FIG. 2.

The longitudinal displacement of the upper portion of each bent leg tube 54 may be achieved as follows. As shown in FIG. 4, the upper portion of each bent leg tube 54 may be provided with a yoke 70 that is adapted to receive an actuator rod 82 and to support a slideable element or slider 72, as shown in FIG. 5. The sliders 72 slideably engage a longitudinally disposed support member or slider tube 74. The actuator rod 82 is displaceable relative to pivot the yoke 70 about pivot point B and move the slider 72 longitudinally relative to the slider tube 74 along the line L—L in FIG. 2 to raise and lower the bed 10.

It can be seen that movement of the legs 16 in a direction of arrow O about the movable upper pivot point B has the affect of rotating the legs 16 in a downward direction while shortening the distance between the movable upper pivot point B and the fixed upper pivot point A. In FIG. 2, the legs 16 are shown extended in a downward position. In contrast, movement of the legs 16 in a direction opposite to that of arrow O has the effect of rotating the legs in an upward direction to retract the legs 16 upward, as indicated in phantom line in FIG. 2.

Figure 6:
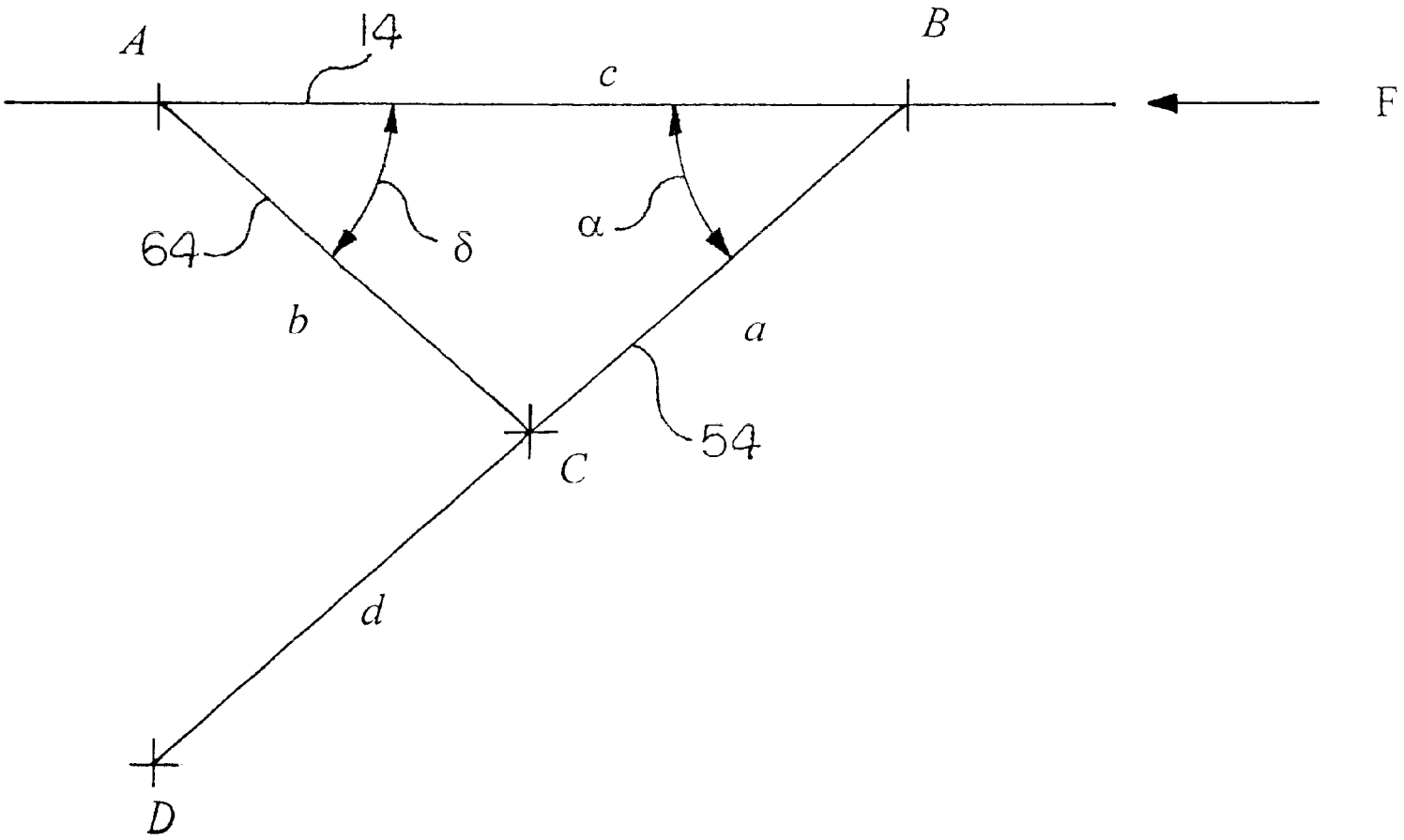
FIG. 6 is a schematic representation of an ideal arrangement of bed elements.

The amount of force required to raise the main frame 14 and sleep surface 12, and thus the load on an actuator 52, is greatest when the legs 16 are fully retracted, or when the sleep surface 12 and the main frame 14 are in a lowered position. FIG. 6 is illustrative of an ideal arrangement of elements. An ideal arrangement of elements is one in which at least three conditions exist. First, the upper fixed and movable pivot points A, B are co-linear with the force F applied. Second, the upper movable and lower orbital pivot points B, C are co-linear with the pivot axis D of the wheels 58, 58'. Lastly, the distances a, b, d between the upper pivot points A, B and the lower pivot point C and further between the lower pivot point C and the pivot axis D of the wheels 58, 58' are substantially equivalent.

In the model depicted in FIG. 6, the initial force F required to raise the sleep surface 12 and main frame 14 beyond a certain threshold is unacceptable. For example, the initial force required to raise the sleep surface 12 can be in the order of about 4,000 pounds. An actuator capable of producing such a force would be too costly or physically too large.

To decrease the amount of force F required to initially raise the sleep surface 12 and main frame 14 outside a certain threshold, the arrangement of elements must depart from the ideal model. First, the distances a, b, d between the upper pivot points A, B and the lower pivot point C and further between the lower pivot point C and the pivot axis D of the wheels 58, 58' may be varied relative to one another. By varying these distances a, b, d, leverage to affect movement of the legs 16 can be increased. The resultant effect is a decrease in the force F required to displace the legs 16. However, the amount in which the distances a, b, d can be varied is limited by physical constraints. These constraints include the maximum sleep surface height set by industry standards and the maximum actuator rod travel of the actuator employed.

To further vary the distances a, b, d, the co-linear relationship between the upper movable and lower orbital pivot points B, C and the pivot axis D of the wheels 58, 58' must be disturbed. For example, disturbing this co-linear relationship permits the horizontal distance c between the upper movable and lower orbital pivot points B, C to be varied further. In other words, leverage can be increased by moving the upper movable pivot point B out of alignment with the lower orbital pivot point C and the pivot axis D of the wheels 58, 58'. The increase in leverage is achieved by decreasing the obtuse angle between the stabilizer leg tubes 64 and the bent leg tubes 54, which results in an increase in the acute angles $\delta$, $\alpha$ between the stabilizer leg tubes 64 and bent leg tubes 54 and between the main frame 14 and the bent leg tubes 54, respectively. The increase in leverage permits the legs 16 to be initially displaced by an acceptable level of force F.

There is a disadvantage associated with varying the distances a, b, d between the upper pivot points A, B and the lower pivot point C and further between the lower pivot point C and the pivot axis D of the wheels 58, 58'. Varying the distances a, b, d causes the pivot axis D of the wheels 58, 58' to orbit and the wheels 58 to move. The wheels 58' at the head end of the bed 10 would likewise move but the flat surfaces inhibit its movement. Movement of the wheels 58 causes the bed 10 to creep. To minimize the translation of the bed 10 caused by movement of the wheels 58, the upper fixed pivot point A may be moved out of linear alignment with the upper movable pivot point B and the force F. By raising the upper fixed pivot point A by a distance dY, the distance b between the upper fixed pivot point A and the lower pivot point C is further increased which further decreases the obtuse angle between the stabilizer leg tubes 64 and the bent leg tubes 54. This has the effect of increasing leverage and minimizing the movement of the wheels 58. The resultant configuration is illustrated in FIG. 10.

Figure 10:
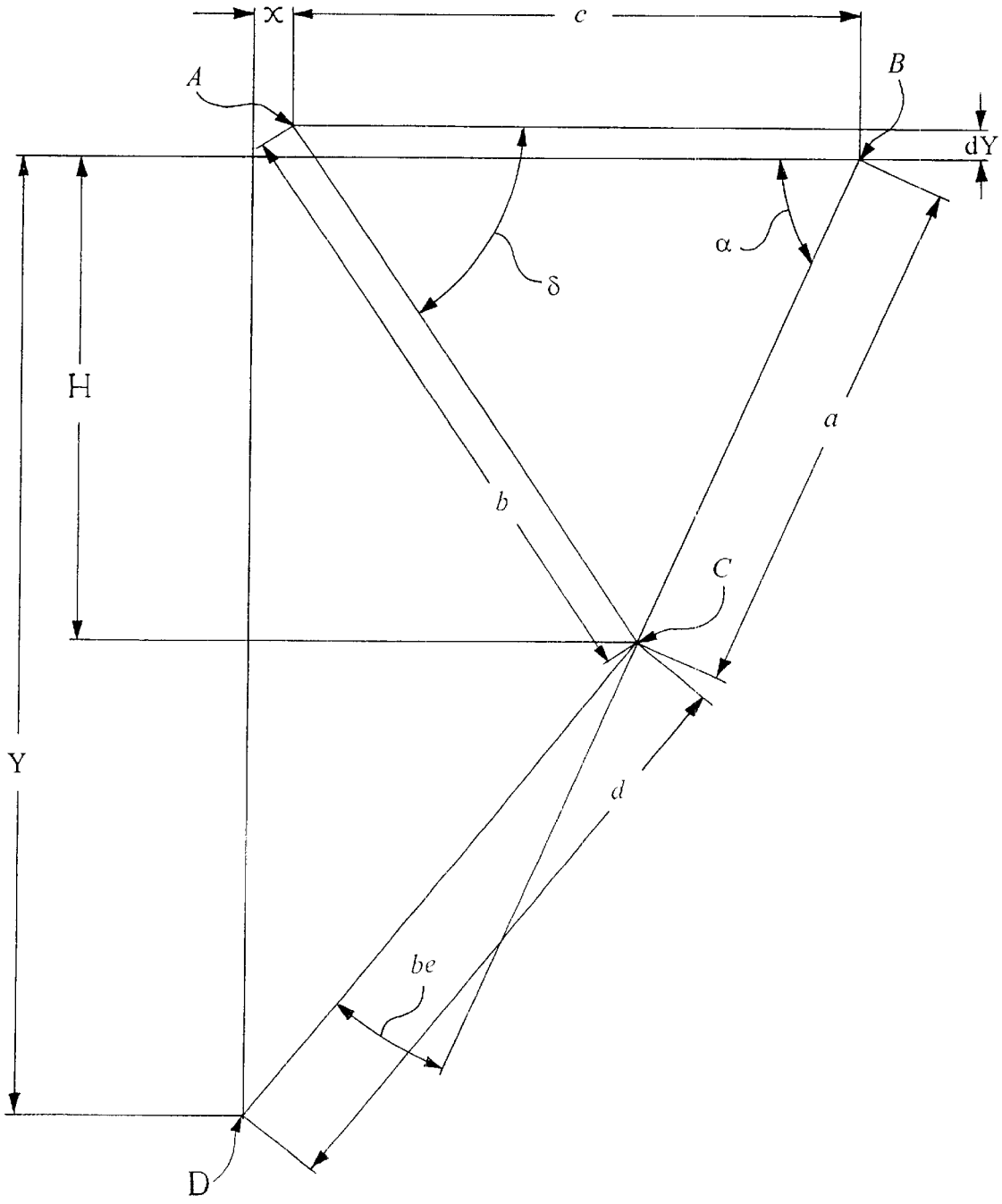
FIG. 10 is a schematic representation of the articulated bed shown in FIGS. 1–5.

There are a large number of variables to work with in arriving at an arrangement of working elements modeled after the resultant configuration illustrated in FIG. 10. The vertical displacement Y is dependent upon the maximum vertical displacement of the sleep surface 12. The maximum elevation of the sleep surface 12 according to industry standards is thirty inches. If a minimum sleep surface elevation of seven inches is desired, the maximum vertical displacement Y would be twenty-three inches, the difference between the minimum and maximum elevations. The vertical displacement Y takes into account the distance between the upper movable pivot point B and the pivot axis D of the wheels 58, 58' when the sleep surface 12 is at the lowest elevation. For example, if the vertical distance between the upper movable pivot point B and the pivot axis D of the wheels 58, 58' is 3.25 inches when the sleep surface 12 is at the lowest elevation, the vertical displacement Y is 26.25 inches.

The horizontal displacement c and the force F are dependent upon the actuator 52 used to raise and lower the sleep surface 12 and the main frame 14. For example, if the maximum length of the actuator rod 82 is 16 inches, the maximum horizontal displacement c cannot exceed 16 inches. Likewise, if the maximum force of the actuator 52 is 1350 pounds, the-maximum force F required to displace the legs 16 cannot exceed 1350 pounds.

Aside from the foregoing values that are established by convention, other variables may demand practical values.

For example, it may be practical to limit the movement x of the wheels 58. Conversely, it may be impractical for the wheels 58 to move a great extent. In the present invention, it is preferred that the movement x of the wheels 58 be limited to a value not greater than 1.5 inches. In addition to the foregoing, other factors relating to the structural characteristics of the bed components, such as stress and load, may need to be considered.

Figure 7:
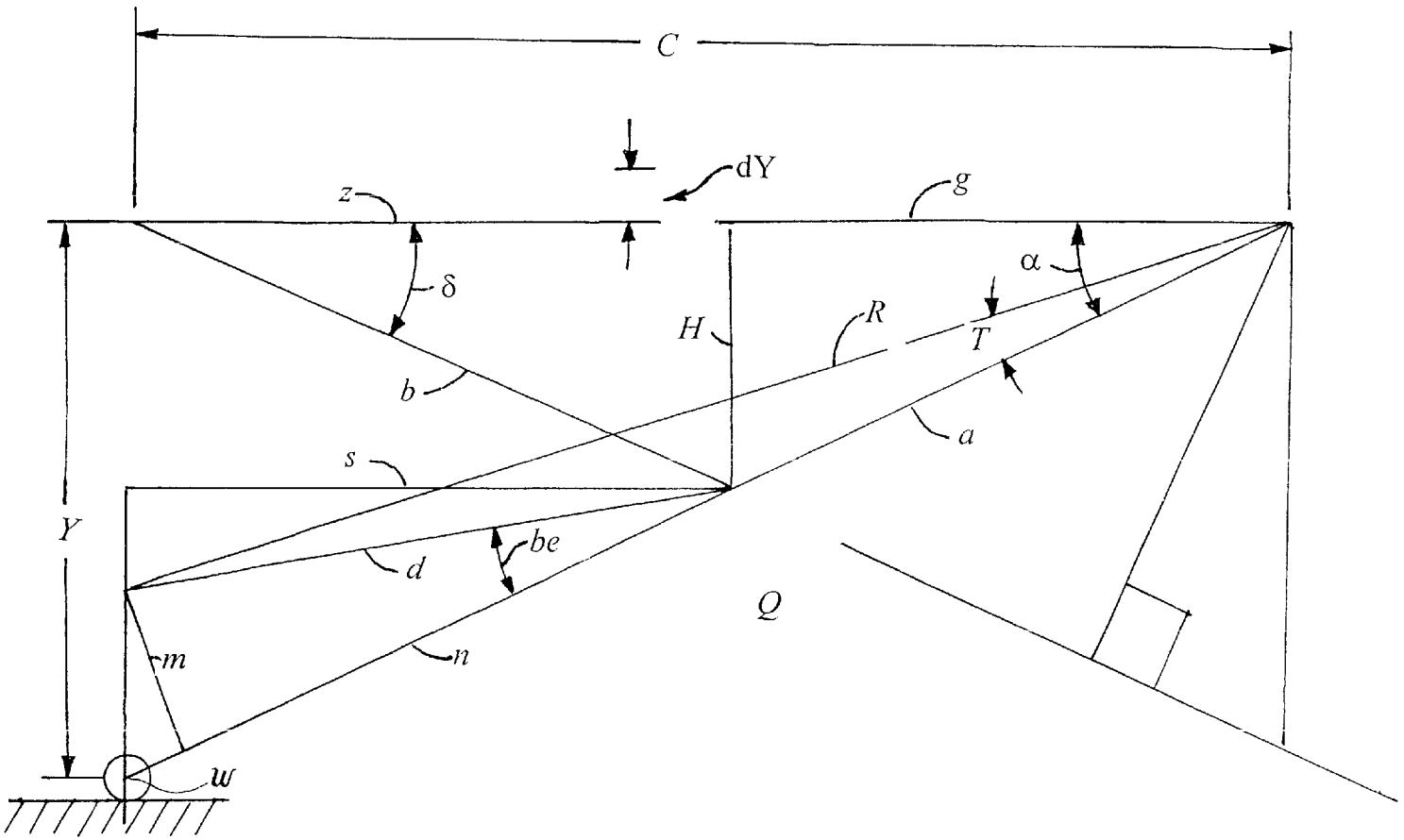
FIG. 7 is a schematic representation of a model of the articulated bed shown in FIG. 1.
Figure 8B:
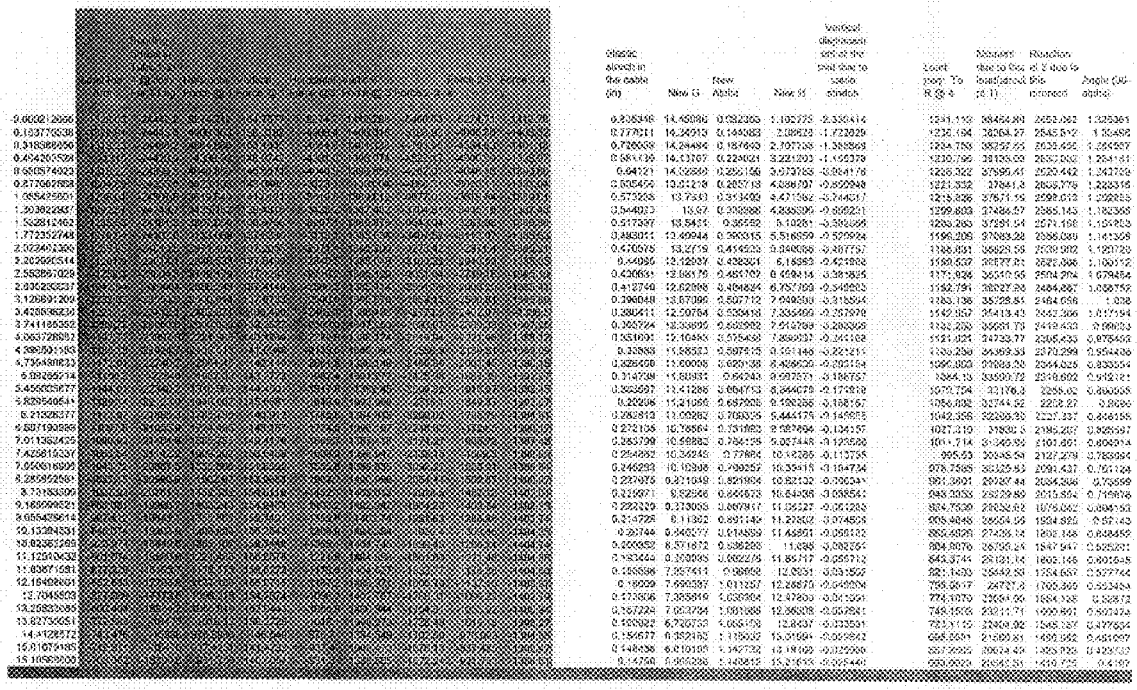
Figure 9D:
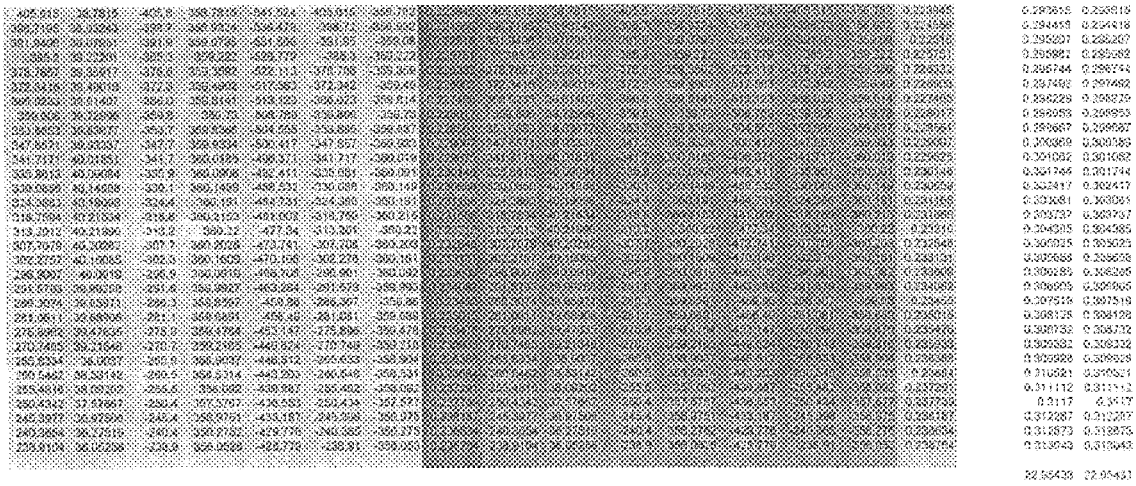

After a range of all the known values is provided, a range of unknown values, such as for the variables depicted in the model illustrated in FIG. 7, may be determined through a series of mathematical expressions or equations. The equations may be entered into a spreadsheet program, such as Microsoft® Excel by Microsoft Corporation, Santa Rosa, Calif., and solved via a seeking operation. An example of a third iteration of a series of mathematical expressions is set forth in Tables I and II hereinbelow. The value for δ shown is the maximum angle permissible between the stabilizer leg tubes 64 and the main frame 14 when the sleep surface 12 and main frame 14 are in the lowest position. In the lowest position, the value of Y should be about 3.25 inches because the actual physical vertical distance between the movable upper pivot point B and the pivot axis D of the wheels 58, 58' is about 3.25 inches when the sleep surface 12 and the main frame 14 are in the lowest position.

TABLE I

| (Calculations for General Loads and Geometry) |
|---|
| Gamma=14.9939484134664 |
| X(s-z)=+P3-J3 |
| Y=+(P3*TAN(M3-B$4))+K3 |
| Gam. Rad=+F3*PI( )/180 |
| z=+B$2*COS(I3) |
| H=+L3-B$6 |
| H+dy=+B$2*SIN(I3) |
| Alpha Rad=+(ASIN((L3-B$6)/B$1)) |
| g=+B$1*COS(M3) |
| c=+J3+N3 |
| s=+(B$10+Q3)*COS(M3) |
| w=+(B$9*TAN(M3)) |
| R-hor=+(B$11*COS(M3-B$12)) |
| Difference=+O3-R3 |
| Angle between d and s=+(ACOS(P3/B$3)) |
| Load Per Arm=(AB3*COS((PI( )/2)-(I3+M3)))/2 |
| Bending Stress in Tube 1-2-4 @ Joint For 1 |
| Leg=+(V3*(((B$1)*(P3/(COS(M3))))/((B$1)+((P3)/COS(M3))))))/C$21 |
| Horizontal Force @ 1=−AC3 |
| Vertical Force @ 1=−(B$14+AD3) |
| Horizontal Force @ 3=−X3 |
| Vertical Force @ 3=−AD3 |
| Force 2-3=−(B$14*(N3+P3))/(((J3+N3)*SIN(I3))-(B$6*COS(I3))) |
| Force 2-3 x=+AB3(*COS(I3)) |
| Force 2-3 y=+AB3*SIN(I3) |
| Elastic stretch in the cable (in)=+(C$17*(X3/C$16^2)*0.000014)/100 |
| New G=+((N3/O3)*AF3)+N3 |
| New Alpha=+(ACOS(AG3/B$1)) |
| New H=+(B$1*SIN(AH3)) |
| Vertical displacement of the bed due to cable stretch=+AI3-K3 |
| Load perp. To R @ 4=+B$14*(COS(M3-B$12)) |
| Moment due to this load (about pt 1)=+AL3*B$11 |
| Reaction at 2 due to this moment=+AM3/B$1 |
| Angle (90-alpha)=+(PI( )/2)-M3 |
| Small angle opposite of Gamma=PI( )-I3-(PI( )-AO3) |
| Force in 2--3 (Not Correct)=+AN3/(COS(AP3)) |
| Angle (atan(w/m))=+ATAN(Q3/B$9) |
| Additional Vertical Force (act. not in line with bracket) lbs=(X3*1.105)/(25.072+(O$3-O3)) |
| A=1.895 |
| B=B$28-AU3 |
| Slider Tube Moment=+((AT3+Y3)*AU3*AV3)/(B$28) |
| Bending Stress=+AW3/D$26 |
| Tube Deflection @ Slider=+((Y3*(AU3^2)*(AV3^2))/(3*B$27*D$29*B$28)) |
| Tube Deflection Max. A>B |
| Tube Deflection Max. |
| B>A=+((Y3*AU3*AV3)*(AV3+2*AU3)*(3*AV3*(AV3+2*AU3))^0.5)/(27*B$27*D$29*B$28) |
| Y=+H3 |
| Angle @ Pivot to 2–3=+C$35*PI( )/180 |
| Angle to Vertical=90*PI( )/180-I3-BD3 |
| Angle 2-3 & 2-4=+PI( )-(PI( )-(I3+M3))-B$4 |
| h=+((B$3^2)+(C$34^2)+(2*B$3*C$34*COS(PI( )-(BD3+BF3))))^0.5 |
| Angle @ Caster to 2-4=+ASIN(C$34*SIN(BD3+BF3)/BG3)+ACOS(((BG3^2+C$33^2-C$36^2)/(2*BG3*C$33))) |
| Distance Between AA & BB=+C$36 |
| Caster Leg to Vertical=+((PI( )/2)-(M3-B$4+BH3))*(180/PI( )) |

TABLE II

| (Calculations for Actuator Speed) |
|---|
| Gamma=14.9939484134664 |
| X(s-z)=+Q3-K3 |
| Y=+(Q3*TAN(N3-B$4))+L3 |
| Gam. Rad=+G3*PI( )/180 |
| z=+B$2*COS(J3) |
| H=+M3-B$6 |
| H+dy=+B$2*SIN(J3) |
| Alpha Rad=+(ASIN((M3-B$6)/B$1)) |
| g=+B$1*COS(N3) |
| c=+K3+O3 |
| s=+(B$10+R3)*COS(N3) |
| w=+(B$9*TAN(N3)) |
| R-hor=+(B$11*COS(N3-B$12)) |
| Difference=+P3-S3 |
| Distance between Supports=+(O$3+Q$3-H$3+H3)*2+3.403 |
| R1 (Head)=+ebw/2+dl/2+(cl*((U3/2)+dcg)/(U3)) |
| R2 (Foot)=+ebw/2+dl/2+(cl*((U3/2)−dcg)/(U3)) |
| Horizontal Force @ 1=−AC3 |
| Vertical Force @ 1=−(V3+AD3) |
| Horizontal Force @ 3=−X3 |
| Vertical Force @ 3=−AD3 |
| Force 2-3=−(V3*(O3+Q3))/(((K3+O3)*SIN(J3))-(B$6*COS(J3))) |
| Force 2-3 x=+AB3(*COS(J3)) |
| Force 2-3 y=+AB3*SIN(J3) |
| Head End Actuator Speed=(0.12/1350)*Z3+0.26 |
| Horizontal Force @ 1=−AK3 |
| Vertical Force @ 1=−(W3+AD3) |
| Horizontal Force @ 3=−AF3 |
| Vertical Force @ 3=−AL3 |
| Force 2-3=−(W3*(O3+Q3))/(((K3+O3)*SIN(J3))-(B$6*COS(J3))) |
| Force 2-3 x=+AJ3*(COS(J3)) |
| Force 2-3 y=+AJ3*SIN(J3) |
| Foot End Actuator Speed=(0.12/1350)*AH3+0.26 |
| Head End Distance Traveled=C$23*AE3 |
| Foot End Distance Traveled=C$23*AM3 |

Data provided in FIGS. 8A–8C and FIGS. 9A–9D represents the results of a goal seeking operation. It should be noted that the maximum amount of force F required to displace the sleep surface 12 and the main frame 14 is 1248 pounds, which is well within the rating of the actuator 52. It should be noted that the movement x of the wheels 58 falls within the preferred limitation of 1.5 inches throughout the displacement of the sleep surface 12 and the main frame 14. However, it should be noted that the wheels 58 encounter movement x in two different directions throughout 30 the displacement of the sleep surface 12 and the main frame 14. Movement x of the wheels 58 in the second direction negates some of the movement x experienced by the wheels 58 in the first direction. The actual movement x experienced by the wheels 58 between the lowest position and the highest position of the sleep surface 12 and the main frame 14 is approximately one inch.

The foregoing data is used to construct an articulated bed in accordance with the model shown in FIG. 9. The kinematic motion of the bed 10 permits the bed 10 to be lowered to a minimum elevation of seven inches and raised to an industry standard elevation of 30 inches. The points A, B, and C representing the fixed, movable and orbital pivot points as well as the orbital pivot axis D of the wheels 58, 58'. The following table represents values suitable for the variables depicted in the model shown.

TABLE III

| (Acceptable Values) |
|---|
| a = 14.500000 |
| b = 17.000000 |

TABLE III-continued

| (Acceptable Values) |
|---|
| c = 15.381660 |
| d = 16.720000 |
| h = 13.241321 |
| x = 1.079767 |
| Y = 26.249426 |
| dY = .875000 |
| δ = 56.1370° |
| be = 15.0000° |

Obviously, the foregoing values are merely an example of the result of a single goal seeking operation given certain known values. The model and the results of the goal seeking operation may vary. The foregoing model maximizes the distance between the fixed upper pivot point A and the movable upper pivot point B when the bed 10 is elevated to the raised position to increase stability. It minimizes the angle between the acute angles 5, a between the stabilizer leg tubes 64 and bent leg tubes 54 and between the main frame 14 and the bent leg tubes 54, respectively, to maximize the vertical distance Y while minimizing the obtuse angle between the stabilizer leg tubes 64 and the bent leg tubes 54 to minimize the force F required and maximize the leverage. The foregoing model also minimizes the length of the distance b between the upper pivot point A and the lower pivot point C, which minimizes the movement or translation of the pivot axis D of the wheels 58, 58' and thus the distance in which the bed 10 may creep. It is conceivable that other models may result using the foregoing approach depending on a variation in physical constraints and the desired results.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An articulated bed comprising:

a main frame;

a leg tube having an upper portion that is longitudinally and pivotally displaceable relative to said main frame at an upper movable pivot point;

a stabilizer having an upper portion and a lower portion, a lower intermediate portion of said leg tube being pivotally connected to said lower portion of said stabilizer at a-lower orbital pivot point, said upper portion of said stabilizer being pivotally connected relative to said main frame at an upper fixed pivot point; and a wheel pivotally attached to a lower portion of said leg tube at a pivot axis, wherein said upper movable pivot point said lower orbital pivot point, and said pivot axis do not coalign and the distance between said upper fixed pivot point and said upper movable pivot point being maximized when said main frame is in a raised position.

2. The bed according to claim 1, wherein said leg tube is bent.

3. The bed according to claim 1, wherein said leg tube is a bent leg tube having opposing legs and wherein said lower portion of said stabilizer is comprised of a short pivot tube and said upper portion of said stabilizer is comprised of a long pivot tube, said short pivot tube being dimensioned to fit between said legs of said bent leg tube and said long pivot tube being dimensioned to fit between stabilizer brackets mounted to side rails of said main frame.

4. The bed according to claim 1, wherein said upper portion of said leg tube is provided with a yoke for receiving an actuator rod and supporting a slider, said slider being slideably engageable with a longitudinally disposed slider tube, said actuator rod being displaceable to pivot said yoke about said upper movable pivot point and move said slider longitudinally relative to said slider tube to raise and lower said bed.

5. The bed according to claim 1, wherein said main frame supports a sleep surface.

6. The bed according to claim 5, wherein said sleep surface includes a head section, a foot section, and a knee section between the head and foot sections, said head and knee sections being pivotally supported by said main frame so as to be adapted to be raised and lowered relative to said main frame, said foot section being pivotally connected to said knee section so that said foot section is adapted to move in response to movement of said knee section.

7. An articulated bed comprising:

a main frame;

a bent leg tube having an upper portion that is longitudinally and pivotally displaceable relative to said main frame at an upper movable pivot point;

a stabilizer having an upper portion and a lower portion, a lower intermediate portion of said bent leg tube being pivotally connected to said lower portion of said stabilizer at a lower orbital pivot point, said upper portion of said stabilizer being pivotally connected relative to said main frame at an upper fixed pivot point; and a wheel pivotally attached to a lower portion of said bent leg tube at a pivot axis, wherein the elevation of said upper fixed pivot point is greater than the elevation of said upper movable pivot point.

8. The bed according to claim 7, wherein said bent leg tube has opposing legs and wherein said lower portion of said stabilizer is comprised of a short pivot tube and said upper portion of said stabilizer is comprised of a long pivot tube, said short pivot tube being dimensioned to fit between said legs of said bent leg tube and said long pivot tube being dimensioned to fit between stabilizer brackets mounted to side rails of said main frame.

9. The bed according to claim 7, wherein said upper portion of said bent leg tube is provided with a yoke that is adapted to receive an actuator rod and to support a slider, said slider being slideably engageable with a longitudinally disposed slider tube, said actuator rod being displaceable relative to pivot said yoke about said upper movable pivot point and move said slider longitudinally relative to said slider tube to raise and lower said bed.

10. The bed according to claim 7, wherein said main frame supports a sleep surface.

11. The bed according to claim 10, wherein said sleep surface includes a head section, a foot section, and a knee section between the head and foot sections, said head and knee sections being pivotally supported by said main frame so as to be adapted to be raised and lowered relative to said main frame, said foot section being pivotally connected to said knee section so that said foot section is adapted to move in response to movement of said knee section.

12. An articulated bed comprising:

a main frame;

a bent leg tube having an tipper portion that is longitudinally and pivotally displaceable relative to said main frame at an upper movable pivot point;

a stabilizer having an upper portion and a lower portion, a lower intermediate portion of said bent leg tube being pivotally connected to said lower portion of said stabilizer at a lower orbital pivot point, said upper portion of said stabilizer being pivotally connected relative to said main frame at an upper fixed pivot point; and a wheel pivotally attached to a lower portion of said bent leg tube at a pivot axis, wherein the distance between said upper fixed pivot point and said lower orbital pivot point, said upper movable pivot point and said lower orbital pivot point, and said lower orbital pivot point and said pivot axis are not equal distances.

13. The bed according to claim 12, wherein said bent leg tube has opposing legs and wherein said lower portion of said stabilizer is comprised of a short pivot tube and said upper portion of said stabilizer is comprised of a long pivot tube, said short pivot tube being dimensioned to fit between said legs of said bent leg tube and said long pivot tube being dimensioned to fit between stabilizer brackets mounted to side rails of said main frame.

14. The bed according to claim 12, wherein said upper portion of said bent leg tube is provided with a yoke that is adapted to receive an actuator rod and to support a slider, said slider being slideably engageable with a longitudinally disposed slider tube, said actuator rod being displaceable relative to pivot said yoke about said upper movable pivot point and move said slider longitudinally relative to said slider tube to raise and lower said bed.

15. The bed according to claim 12, wherein said main frame supports a sleep surface.

16. The bed according to claim 15, wherein said sleep surface includes a head section, a foot section, and a knee section between the head and foot sections, said head and knee sections being pivotally supported by said main frame so as to be adapted to be raised and lowered relative to said main frame, said foot section being pivotally connected to said knee section so that said foot section is adapted to move in response to movement of said knee section.

17. An articulated bed comprising:

a main frame supported by a pair of opposing legs and corresponding stabilizers, wherein each said leg comprising a bent leg tube having an upper portion that is longitudinally and pivotally displaceable relative to said main frame at an upper movable pivot point, and wherein each said stabilizer having an upper portion and a lower portion, a lower intermediate portion of each said bent leg tube being pivotally connected to said lower portion of a corresponding one of said stabilizers at a lower orbital pivot point, said upper portion of each said stabilizer being pivotally connected relative to said main frame at an upper fixed pivot point, and wherein said lower portion of each said bent leg tube having a wheel pivotally attached thereto at a pivot axis, wherein said upper movable pivot point, said lower orbital pivot point, and said pivot axis do not coalign and the distance between said upper fixed pivot point and said upper movable pivot point being maximized when said main frame is in a raised position.

18. The bed according to claim 17, wherein said bent leg tube has opposing legs and wherein said lower portion of said stabilizer is comprised of a short pivot tube and said upper portion of said stabilizer is comprised of a long pivot tube, said short pivot tube being dimensioned to fit between said legs of said bent leg tube and said long pivot tube being dimensioned to fit between stabilizer brackets mounted to side rails of said main frame.

19. The bed according to claim 17, wherein said upper portion of said bent leg tube is provided with a yoke that is adapted to receive an actuator rod and to support a slider, said slider being slideably engageable with a longitudinally disposed slider tube, said actuator rod being displaceable relative to pivot said yoke about said upper movable pivot point and move said slider longitudinally relative to said slider tube to raise and lower said bed.

20. The bed according to claim 17, wherein said main frame supports a sleep surface including a head section, a foot section, and a knee section between the head and foot sections, said head and knee sections being pivotally supported by said main frame so as to be adapted to be raised and lowered relative to said main frame, said foot section being pivotally connected to said knee section so that said foot section is adapted to move in response to movement of said knee section.

* * * * *

UNITED STATES PATENT AND TRADEMARK OFFICE

CERTIFICATE OF CORRECTION

PATENT NO. : 6,473,922 B1
DATED : November 5, 2002
INVENTOR(S) : Dean R. Sommerfeld et al.

It is certified that error appears in the above-identified patent and that said Letters Patent is hereby corrected as shown below:

Column 8,
Line 50, delete "-" between "a" and "lower"

Column 9,
Line 65, delete "tipper" and insert -- upper --

Signed and Sealed this

Eighteenth Day of February, 2003

JAMES E. ROGAN
*Director of the United States Patent and Trademark Office*